US009468280B2

(12) United States Patent
Uehara et al.

(10) Patent No.: US 9,468,280 B2
(45) Date of Patent: Oct. 18, 2016

(54) LIP COSMETIC APPLICATOR DEVICE

(75) Inventors: Kazuyuki Uehara, Tokyo (JP); Yu Saito, Tokyo (JP); Kenko Kurita, Tokyo (JP); Masahiro Oka, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/501,004

(22) PCT Filed: Oct. 8, 2010

(86) PCT No.: PCT/JP2010/067782

§ 371 (c)(1),
(2), (4) Date: May 1, 2012

(87) PCT Pub. No.: WO2011/043470

PCT Pub. Date: Apr. 14, 2011

(65) Prior Publication Data

US 2012/0204899 A1 Aug. 16, 2012

(30) Foreign Application Priority Data

| | | |
|---|---|---|
| Oct. 9, 2009 | (JP) | 2009-235748 |
| Oct. 9, 2009 | (JP) | 2009-235768 |
| Oct. 9, 2009 | (JP) | 2009-235775 |
| Nov. 30, 2009 | (JP) | 2009-270913 |

(51) Int. Cl.
*A45D 40/26* (2006.01)
*A45D 34/04* (2006.01)

(52) U.S. Cl.
CPC ..... *A45D 40/26* (2013.01); *A45D 34/04* (2013.01); *A45D 34/042* (2013.01);
(Continued)

(58) Field of Classification Search
CPC .. A45D 34/045; A45D 34/046; A45D 34/04; A45D 40/267; A45D 40/26; A45D 40/264; A45D 40/265; A45D 2200/1018; A45D 33/00; A45D 40/262; A45D 40/268; A45D 40/28; A45D 2200/10; A45D 2200/1036; A45D 2200/1045; A45D 34/043; A45D 34/047; A46B 9/021; A46B 2200/10; A46B 2200/1046; A61F 13/38; A61M 35/00; A61M 35/003
USPC ..... 132/216–218, 317, 318, 320; D28/7, D28/85, 76, 86–90; 401/121, 122, 126, 196, 401/202, 261, 265, 266, 128–130; D9/723–729; D24/119; 206/581, 361, 206/363, 368, 385, 63.5; 604/1; 15/160, 15/244.1, 245.1
See application file for complete search history.

(56) References Cited

U.S. PATENT DOCUMENTS

| | | | | |
|---|---|---|---|---|
| 1,909,096 | A * | 5/1933 | Cooney | 401/130 |
| 2,442,503 | A * | 6/1948 | Melnikoff | 132/320 |

(Continued)

FOREIGN PATENT DOCUMENTS

| | | |
|---|---|---|
| CN | 1868369 A | 11/2006 |
| EP | 1 369 056 A1 | 12/2003 |

(Continued)

OTHER PUBLICATIONS

International Search Report issued on Nov. 2, 2010 in PCT/JP10/067782 filed on Oct. 8, 2010.

*Primary Examiner* — Tatiana Nobrega
(74) *Attorney, Agent, or Firm* — Oblon, McClelland, Maier & Neustadt, L.L.P.

(57) ABSTRACT

A lip cosmetic applicator device (1) including an applicator (2) for applying a cosmetic (4) to a lip and a receptacle (3) for containing the cosmetic (4). The applicator (2) is withdrawable from and insertable into the receptacle through a neck (33) of the receptacle (3). The applicator (2) includes a stem (22) and an applying portion (21) connected to one end of the stem (22). The applying portion (21) is a flattened shape and has an applying side (21A) for applying the cosmetic (4). When viewed from the front, the applying portion (21) has a widest part (21E) and gradually decreases in width from the widest part (21E) to a tip thereof. The applying side (21A) of the applying portion (21) is a concave surface having a concavity (21C) in a center thereof.

34 Claims, 21 Drawing Sheets

(52) U.S. Cl.
CPC ..... *A45D 34/045* (2013.01); *A45D 34/046* (2013.01); *A45D 40/262* (2013.01); *A45D 40/267* (2013.01); *A45D 2200/1018* (2013.01)

(56) References Cited

U.S. PATENT DOCUMENTS

| | | | | |
|---|---|---|---|---|
| 3,863,654 | A * | 2/1975 | Morane et al. | 132/320 |
| 5,816,270 | A * | 10/1998 | Nadel | 132/320 |
| 5,855,214 | A * | 1/1999 | Heneghan | 132/320 |
| 6,220,254 | B1 * | 4/2001 | Gueret | 132/313 |
| 6,331,085 | B1 | 12/2001 | Schrepf et al. | |
| D566,331 | S * | 4/2008 | Hartstock | D28/7 |
| 7,677,826 | B2 * | 3/2010 | Gueret | 401/130 |
| D614,347 | S * | 4/2010 | Uehara et al. | D28/7 |
| D617,045 | S * | 6/2010 | Uehara et al. | D28/7 |
| D628,741 | S | 12/2010 | Uehara et al. | |
| 7,866,327 | B1 * | 1/2011 | Gueret | 132/218 |
| D633,650 | S | 3/2011 | Uehara et al. | |
| 7,967,519 | B2 * | 6/2011 | Gueret | 401/122 |
| 8,082,928 | B2 * | 12/2011 | Gueret | 132/218 |
| 8,205,624 | B2 * | 6/2012 | Gueret | 132/218 |
| 8,286,649 | B2 * | 10/2012 | Gueret | 132/320 |
| 2003/0168076 | A1 * | 9/2003 | Vieu et al. | 132/317 |
| 2004/0009028 | A1 | 1/2004 | Gueret | |
| 2004/0018037 | A1 | 1/2004 | Gueret | |
| 2004/0237996 | A1 * | 12/2004 | Fischer et al. | 132/320 |
| 2005/0217691 | A1 * | 10/2005 | Petit | 132/320 |
| 2007/0017544 | A1 * | 1/2007 | Gueret | 132/320 |
| 2007/0020027 | A1 | 1/2007 | Gueret | |
| 2007/0181143 | A1 * | 8/2007 | Montoli | 132/320 |
| 2007/0227553 | A1 * | 10/2007 | Gueret | 132/320 |
| 2008/0107470 | A1 * | 5/2008 | Gueret | 401/129 |
| 2008/0273914 | A1 | 11/2008 | Hamada | |
| 2008/0317542 | A1 * | 12/2008 | Gueret | 401/121 |
| 2011/0030718 | A1 * | 2/2011 | Gueret | 132/218 |
| 2011/0170937 | A1 * | 7/2011 | Gueret | 401/130 |
| 2012/0039658 | A9 * | 2/2012 | Gueret | 401/122 |
| 2012/0132222 | A1 * | 5/2012 | Gueret | 132/200 |
| 2012/0312315 | A1 * | 12/2012 | Gueret | 132/200 |

FOREIGN PATENT DOCUMENTS

| | | | | |
|---|---|---|---|---|
| JP | 2001 8727 | | 1/2001 | |
| JP | 2003-235641 | A | 8/2003 | |
| JP | 2003-310346 | A | 11/2003 | |
| JP | 2004-000587 | A | 1/2004 | |
| JP | 2006-081890 | A | 3/2006 | |
| JP | 2006 326320 | | 12/2006 | |
| JP | 2007 21230 | | 2/2007 | |
| JP | 2007 236977 | | 9/2007 | |
| JP | 2008 12177 | | 1/2008 | |
| JP | 2009-219630 | A | 10/2009 | |
| JP | 2010 131329 | | 6/2010 | |
| WO | WO 2012117322 | A1 * | 9/2012 | A45D 34/04 |

* cited by examiner

LIP COSMETIC APPLICATOR DEVICE

CROSS REFERENCE TO RELATED APPLICATION

This application is a 371 of PCT/JP10/067782, filed on Oct. 8, 2010, and claims priority to the following Japanese Patent Applications: 2009-235748, filed on Oct. 9, 2009; 2009-235768, filed on Oct. 9, 2009; 2009-235775, filed on Oct. 9, 2009; and 2009-270913, filed on Nov. 30, 2009.

TECHNICAL FIELD

The present invention relates to a lip cosmetic applicator device suitable for applying lip cosmetics, such as lipstick and lip gloss.

BACKGROUND ART

Applicators for applying lip cosmetics, such as lipstick and lip gloss, composed of a supporting stem and an applying portion at the tip of the stem are commonly used. The applying portion is configured to have an increased retention of the cosmetic so that the cosmetic may be applied over an increased area by a single applying operation such that the lips may be made up by a reduced number of applying operations. To reduce the number of applying operations is advantageous to avoid a patchy application and achieve uniform application of the cosmetic.

An applying portion that projects laterally from the stem and includes at least two branches of a plastic material is known as a device for increasing the retention of a cosmetic (see patent publication 1 below). The branches have respective ends, and the ends meet each other to define a cavity between the branches. The applying portion is able to retain a cosmetic in its cavity and therefore has increased retention.

Apart from the above technique, patent publication 2 below discloses an applying portion that is wider than the supporting stem and flat. The applying portion is described as gradually decreasing in width from its widest part to the tip when viewed from the front and being inclined with respect to the stem, thereby achieving improvements on the feel on the skin, make-up finish, convenience of use, and the like. For example, to have a fine pointed tip is advantageous in that a cosmetic may be applied delicately, making it easier to apply the cosmetic to the ends of the lips.

An applicator is usually used in combination with a cylindrical receptacle containing a cosmetic. The applicator of this type is designed such that the applying portion immersed in the cosmetic in the receptacle is withdrawn and wiped by a wiper provided near the neck of the receptacle to remove excess cosmetic before application. According to patent publication 2, the wiper is made of a rigid or semi-rigid plastic material and therefore is substantially non-deformable, while the applying portion is more deformable than the wiper so that the applying portion is flat and wider than the stem, which may be wiped through the wiper.

CITATION LIST

Patent Publications

Patent publication 1: US 2007/0020027A1

Patent publication 2: JP 2001-8727A (FIGS. 12 to 14)

SUMMARY OF INVENTION

Technical Problem

According to the disclosure of patent publication 1, the branches defining the cavity are stiff enough not to be substantially deformed. Having substantially no deformability, the cavity can fail to serve as a smooth supply of the cosmetic retained therein. Furthermore, because the cavity extends to the back side of the applying portion, the cosmetic is pressed from the applying side through the cavity to the back side by the pressure of applying the applying portion to a target region of skin. That is, the cosmetic retained in the applying portion is not effectively used.

The diameter of a wiper orifice is usually designed to suit the diameter of the stem so as to prevent adhesion of the cosmetic to the stem. Then, when the applying portion that projects laterally from the stem is withdrawn from or re-inserted into the receptacle, it will be met with a large resistance, and the convenience of use is reduced. For example, when the applying portion is covered in flocking, the flocking can come off, resulting in reduction of durability of the applying portion.

A fine pointed tip of an applying portion such as described in patent publication 2 can fail to be sufficiently deprived of excess cosmetics when withdrawn from the cosmetic-containing receptacle and wiped through a wiper of the receptacle. This is because the tip of the applying portion has a too small cross-section compared to the size of the wiper orifice to be wiped sufficiently. As a result, excess cosmetic may pool at the tip of the applying portion. If the applying portion with such a pool of the cosmetic is used, the cosmetic may be applied excessively to cause inconveniences, such that the cosmetic runs off the outline of the lips, or, when the applying portion is withdrawn from the receptacle, the cosmetic may form a thread to look awkward, and the thread can cut and drop to soil the surroundings.

Solution to Problem

The invention provides a lip cosmetic applicator device including an applicator for applying a cosmetic to a lip and a receptacle for containing the cosmetic. The applicator is able to be withdrawn from and insertable into the receptacle through a neck of the receptacle. The applicator includes a stem and an applying portion connected to one end of the stem. The applying portion is a flattened shape and has an applying side for applying the cosmetic. When viewed from the front, the applying portion has a widest part and gradually decreases in width from the widest part to a tip of the applying portion. The applying side is formed of a concave surface having a concavity at a center of the applying side.

Advantageous Effects of Invention

According to the invention, a given large quantity of a cosmetic can be retained in the applying portion through a simple operation of wiping the applying portion through a wiper. A cosmetic is retained over the entire applying side of the applying portion so that the cosmetic may be applied uniformly. Adhesion of a cosmetic to the back side of the applying portion is minimized so that the undesired application of the cosmetic to a target other than the target region may be prevented during cosmetic application.

According to the invention, dripping or threading of a cosmetic is prevented effectively without impairing the ease of applying the cosmetic to a delicate target region, such as the ends of the lips.

According to the invention, the wide and flattened applying portion is allowed to be wiped effectively with a reduced resistance and thereby with reduced damage when passing through the wiper. As a result, an adequate and moderate cosmetic pickup by, and cosmetic distribution in, the applying portion are achieved to provide a neat finish with ease.

The cosmetic applicator device of the invention produces the above effects to provide a neat finish to the lips in applying a lip cosmetic, particularly lipstick or lip gloss, to the lips.

BRIEF DESCRIPTION OF DRAWINGS

FIG. 3(*b*) is a side view of the applying portion of the cosmetic applicator device shown in FIG. 1. FIG. 3(*c*), FIG. 3(*d*), and FIG. 3(*e*) are cross-sections taken along line c-c, line d-d, and line e-e, respectively, in FIG. 3(*b*).

FIG. 9(*b*) is a cross-section taken along b-b line in FIG. 9(*a*). FIG. 9(*c*) is a cross-section illustrating the applying portion shown in FIG. 9(*b*) in its deformed state.

FIG. 13(*c*), FIG. 13(*d*), and FIG. 13(*e*) are cross-sections taken along line c-c, line d-d, and line e-e, respectively, in FIG. 13(*b*).

FIG. 14(*b*) is a schematic front view of the applying portion having further withdrawn from the position shown in FIG. 14(*a*). FIG. 14(*c*) is a schematic side view of the state shown in FIG.14(*b*).

FIG. 16(*b*) is a cross-section taken along b-b line in FIG. 16(*a*). FIG. 16(*c*) is a cross-section illustrating the applying portion shown in FIG. 16(*b*) in a substantially C-shape deformed state.

FIG. 18(*b*) is a side view with a part cut away of the lip cosmetic applicator device of FIG. 18(*a*).

FIG. 19(*c*) illustrates schematic bottom views of the flexible wiper with the applying portion omitted.

FIG. 20(*c*) illustrates schematic bottom views of the flexible wiper with the applying portion omitted.

FIG. 21(*c*) illustrates schematic bottom views of the flexible wiper with the applying portion omitted.

FIG. 22(*b*) illustrates a state in which a cosmetic deposited on the lower side of a flexible wiper is prevented from being picked up by the applying portion in an embodiment of the invention.

DESCRIPTION OF EMBODIMENTS

Figure 1:
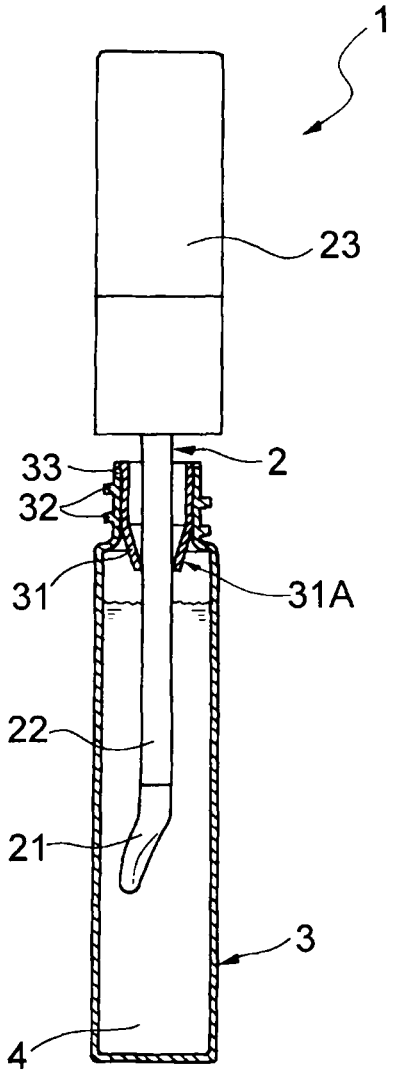
FIG. 1 is a front view with a part cut away of an embodiment of the cosmetic applicator device according to the invention.

The lip cosmetic applicator device of the invention will be illustrated based on its preferred embodiments with reference to the accompanying drawings. The embodiments shown in the drawings are only illustrative and are not to be construed as limitations to the invention. FIG. 1 presents a front view of a first embodiment of the lip cosmetic applicator device of the invention, with a part cut away. The lip cosmetic applicator device of the embodiment shown in FIG. 1 includes an applicator 2 for applying a cosmetic 4 and a receptacle 3 for containing the cosmetic 4. The applicator 2 and the receptacle 3 will be described.

First of all, the receptacle 3 will be described. The receptacle 3 is a bottomed, long and narrow cylindrical receptacle and is configured to contain a liquid cosmetic 4. The receptacle 3 has a neck 33 opposite to the bottom. The neck 33 is open upward. The neck 33 has a threaded portion 32 around its outer periphery. The threaded portion 32 is screwable into the unshown threaded portion provided on the inner periphery of a cap 23 (hereinafter described) of the applicator 2.

The receptacle 3 has a wiper 31 provided close to the neck 33. The wiper 31 has the shape of a funnel tapered from the neck 33 towards the bottom of the receptacle 3 and has a wiper orifice 31A at the lower end thereof. The wiper orifice 31A serves as an orifice for wiping to remove excess cosmetic. The wiper orifice 31A is such that allows passage of a hereinafter described applying portion 21 and a hereinafter described stem 22 of the applicator 2. The wiper orifice 31A is located in substantially the central portion of the wiper 31 in a transverse cross-section of the receptacle 3. The shape of the wiper orifice 31A is circular but not limited thereto. The wiper orifice 31A has a size enabling the applying portion 21 located at the tip of the applicator 2 to be inserted into the receptacle 3 or withdrawn from the receptacle 3. The wiper 31 is used to moderately wipe off the excess of the cosmetic 4 having adhered to the applying portion 21 or the stem 22 of the applicator 2. For this purpose, the wiper 31 is made of an elastically deformable material, such as rubber. While the wiper 31 shown in FIG. 1 extends to slightly below the neck 33, it may be at the position of the neck 33. Thus, the expression "close to the neck 33" as used herein is intended to be at a location from the upper end of the neck 33 to slightly below the neck 33.

The cosmetic 4 to be contained in the receptacle 3 may be any of lip cosmetic products having flowability in the environment of use. Such cosmetic products are well known in the art and include various kinds of lipstick and lip cosmetics called lip gloss or lip colors that are used to give lips a glossy luster finish.

The applicator 2 used in combination with the receptacle 3 includes an applying portion 21 and a stem 22. These members are withdrawable from and insertable into the receptacle 3 through the neck 33 of the receptacle 3. The applying portion 21 serves to apply the cosmetic 4 to lips and the like. The stem 22 connects at one end thereof to the applying portion 21. The applying portion 21 and the stem 22 may be integrally formed of the same material or may be separate members that are connected to each other by a prescribed means.

In the case when the applicator is made by connecting separately prepared applying portion 21 and stem 22, the two members are preferably connected by fitting one into another. For example, the applying portion 21 or the stem 22 is plastically deformed by, for example, punching to fix the applying portion 21 and the stem 22 to each other. Other known connecting means, such as adhesion with an adhesive, may be used as appropriate.

The applicator 2 also has a cap 23. The cap 23 connects to the other end of the stem 22. As mentioned above, the cap 23 has on its inner periphery a threaded portion (not shown) that is screwable onto the threaded portion 32 of the receptacle 3. With the cap 23 screwed onto the threaded portion 32 of the receptacle 3, the applicator device 1 is substantially cylindrical. In this state, the applying portion 21 is slightly above the bottom of the receptacle 3.

Figure 2:
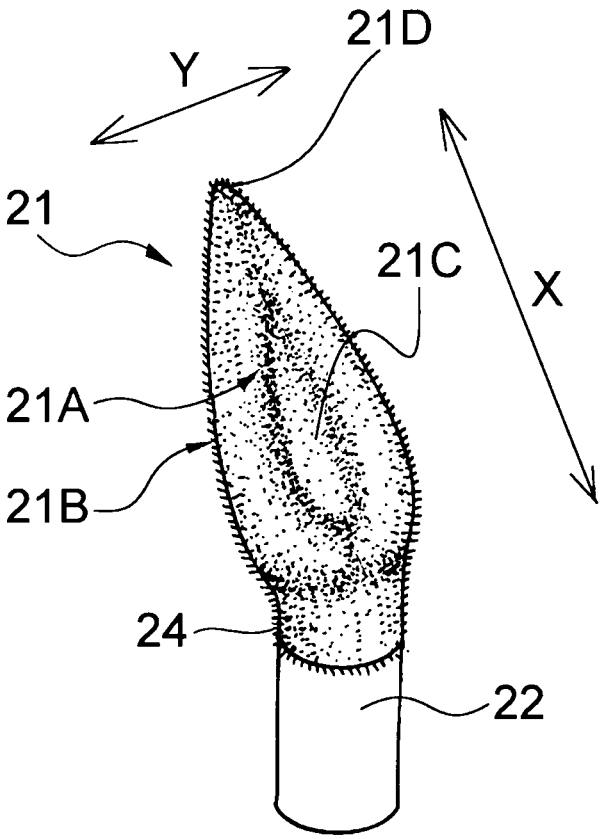
FIG. 2 is an enlarged perspective view of the applying portion of the cosmetic applicator device shown in FIG. 1.
Figure 3A:
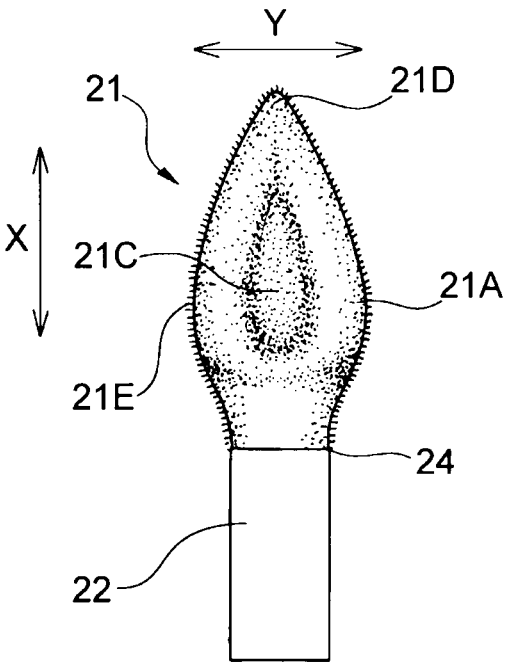
FIG. 3(*a*) is a front view of the applying portion of the cosmetic applicator device shown in FIG. 1.
Figure 3B:
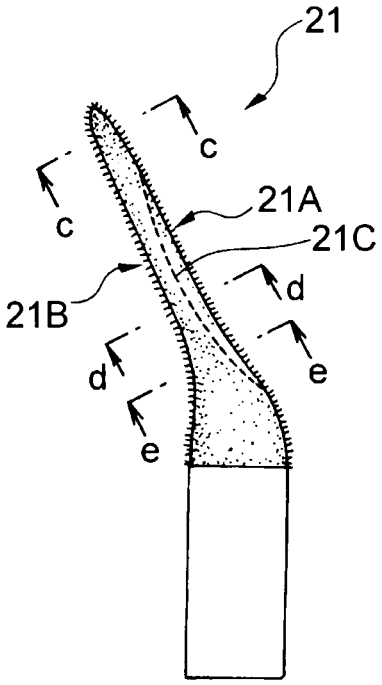
Figure 3C:
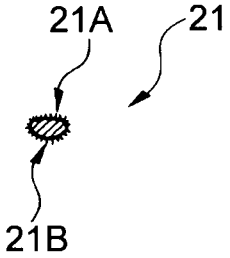
Figure 3D:
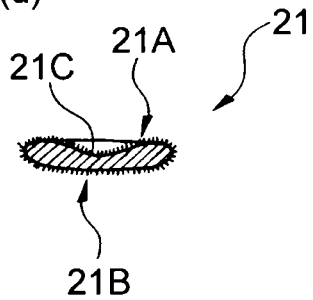
Figure 3E:
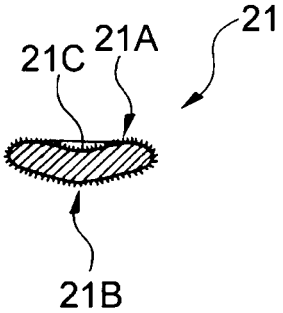

FIG. 2 is an enlarged view of the applying portion 21, in which the applying portion 21 is depicted upside down relative to that in FIG. 1. As shown in FIG. 2, the applying portion 21 is a flattened shape and wider than the stem 22. The applying portion 21 is longer than wide, having a longitudinal direction X coincident with the longitudinal direction of the stem and a width direction Y perpendicular to the longitudinal direction X.

The applying portion 21 has at least one characteristic such that it is deformed with its first side 21A inward when passing through the wiper 31 of the receptacle 3. As will be described later, the applying portion 21 is desirably deformed into a substantial C-shape in conformity to the orifice of the wiper 31.

The flattened, longer-than-wide applying portion 21 has a first side 21A that is an applying side and a second side 21B opposite to the first side. The first side 21A is concave with respect to the width direction Y of the applying portion 21. The second side 21B is flat or slightly convex.

The applying portion 21 has a concavity 21C in the center of the first side 21A having a concave surface. The concavity 21C chiefly serves to retain the cosmetic 4 on the first side 21A. The concavity 21C extends in the longitudinal direction of the applying portion 21. The thickness of the applying portion 21 in the concavity 21C is smaller than that of the peripheral portion of the concavity 21C.

The applying portion 21 is inclined at a prescribed angle with respect to the stem 22. In detail, the applying portion 21 is inclined with respect to the axis of the stem 22 such that the first side 21A, which is the concave side of the applying portion 21, faces the bottom of the receptacle 3 when the applicator 2 is in the receptacle 3. With the applying portion 21 and the stem 22 being connected at such an inclination angle, the applying portion 21 is made deformable in a desired fashion, and application of the cosmetic 4 using the applicator 2 is easy. These effects will be described later in detail.

The applying portion 21 is covered in flocking. The flocking fibers are preferably 0.1 to 3 mm in length and 0.5 to 5 dtex in thickness. Two or more different kinds of fibers may be used in combination with the length and thickness falling within the above respective ranges. The material of the fibers is chosen as appropriate to the feel desired on application. In general, a pleasing soft feel to the touch will be obtained by using a polyamide resin. The flocking finish to the surface of applying portion 21 may be achieved by an appropriately chosen known technique, such as electrostatic flocking.

FIGS. 3(*a*) through 3(*e*) present a front view, a side view, and transverse cross-sectional views of the applying portion 21 shown in FIG. 2. As is obvious from these figures as well as FIG. 2, the overall outer surface of the applying portion 21 before being covered in flocking is defined by curved surfaces, except for the tip. In other words, the applying portion 21 before being flocked has a smooth surface with no angular parts except the tip.

The applying portion 21 before being flocked is smooth on its entire surface. That is, the applying portion 21 before being flocked has no surface textures, such as a wrinkle finish or a matte finish, over the entire surface thereof. To put it another way, the applying portion 21 before being flocked is smooth and slippery. When a cosmetic is applied using the applicator device 1 of the present embodiment onto, for example, lips having a different cosmetic already applied thereto, it is successfully applied over the previously applied cosmetic without wiping or scraping the previously applied cosmetic owing to its unique shape as described. Furthermore, the cosmetic remaining on the applying portion 21 is easily removed after use. This is advantageous in that the cosmetic contained in the receptacle 3 is effectively prevented from being colored or changing to become a different color due to the different cosmetic entering together with the applying portion 21 re-inserted into the receptacle 3.

In applying the cosmetic, the applying portion 21 is able to retain an increased quantity of the cosmetic because of the synergistic effect brought about by the combination of the curvedness (except for the tip) and smoothness of the entire outer surface of the applying portion 21 before being flocked and the effect of the flocking finish. As a result, the number of the applying operations is reduced. To cover the applying portion in flocking produces another advantage that the applying portion feels soft when applied to the lips.

As shown in FIGS. 2 and 3, the applying portion 21 has a widest part 21E when viewed from the front, i.e., in a cross-section taken along the width direction Y. The applying portion 21 preferably has one widest part but may have two or more wide parts. The widest part 21E may extend over a certain length. The applying portion 21 gradually decreases in width from the widest part 21E to a connecting position 24 where the applying portion 21 and the stem 22 are connected to each other. As used herein, the term "width" is defined to mean to be the length in the direction Y in FIG. 3(*a*). The width of the applying portion 21 and the width (i.e., the diameter) of the stem 22 are substantially equal at the connecting position 24. The widest part 21E is at a position distant from the tip 21D of the applying portion 21. The applying portion 21 also gradually decreases in width from the widest part 21E to the tip 21D. The tip 21D is preferably sharply pointed. To have a sharply pointed tip 21D is to help delicately and finely apply the cosmetic to, for example, the ends of the lips. In short, the applying portion 21 has its width gradually increased from the tip 21D to the widest part 21E and gradually decreased from the widest part 21E to the connecting position 24.

One of the characteristics of the applicator device 1 of the present embodiment resides in the relation between the width of the widest part 21E of the applying portion 21 and the size of the wiper orifice 31A of the wiper 31. In more detail, the widest part 21E has a larger width than the widest part of the wiper orifice 31A. Accordingly, when the applicator 2 shown in FIG. 1 is withdrawn from the receptacle 3, the widest part 21E of the applying portion 21 catches in the wiper orifice 31A of the wiper 31. Since the applying portion 21 is made of an elastically deformable material in the present embodiment, it is deformed at the widest part 21E catching in the wiper orifice 31A so as to be able to pass through the wiper orifice 31A. The applying portion 21 is configured to be deformed to make a substantial C-shape with the first side 21A inward. The advantages obtained by such a way of deformation will be explained by referring to FIG. 4.

Figure 4A:
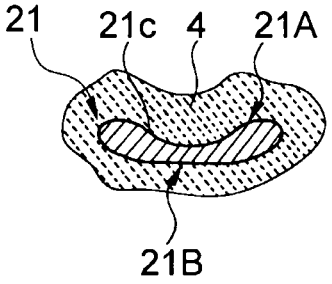
FIG. 4(*a*), FIG. 4(*b*), and FIG. 4(*c*) each schematically illustrate the states of the applying portion having a cosmetic attached thereto before, during, and after the passage through the orifice of a wiper, respectively.
Figure 4B:
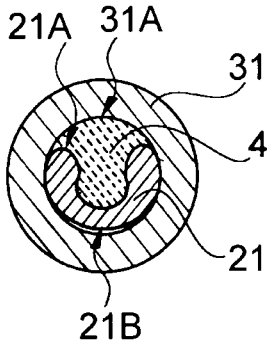
Figure 4C:
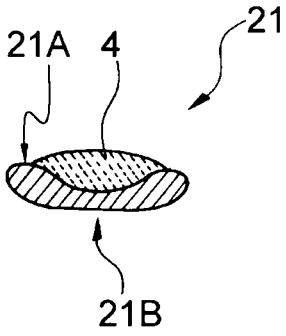

Upon withdrawing the applying portion 21 from the state of being immersed in the cosmetic 4 (the state shown in FIG. 1), the cosmetic 4 is picked up and retained on the entire surface of the applying portion 21 as shown in FIG. 4(*a*).

On further withdrawing the applying portion 21 until the applying portion 21 comes into contact with the wiper 31, further withdrawal is impeded by the wiper 31. However, the applying portion 21 is, being made of an elastically deformable material, allowed to be deformed so as to pass through the orifice 31A of the wiper 31. Since the first side 21A of the applying portion 21, where most of the cosmetic is retained, has a concave surface, the applying portion 21 is deformed into a substantial C-shape with the first side 21A inward as shown in FIG. 4(*b*). To have a smaller thickness in the concavity 21C of the first side 21A is helpful for the applying portion 21 to be deformed with its first side 21A inward. Since the applying portion 21 is substantially C-shaped with the first side 21A inward, the cosmetic 4 remains retained inside the C-shape while the applying portion 21 is in a deformed state. On the other hand, the outer side, i.e., the second side 21B of the substantially C-shaped applying portion 21 forms a convexity and is wiped by the wiper 31 to be deprived of the cosmetic 4 attaching thereto (see FIG. 5). A given large quantity of the cosmetic is thus retained.

The wiper 31 may be made of an elastically deformable material, so that both the applying portion 21 and the wiper orifice 31A are deformed to reduce the resistance against the withdrawal and insertion, whereby the convenience of use is further improved. In this case, the applying portion 21 is deformed into a slightly less curved C-shape (with the circumscribed circle of the applying portion 21 in cross-section having a larger diameter) while passing through the orifice 31A, and the orifice 31A shown in FIG. 4(*b*) is pressed from the inside by the applying portion 21 and deformed into a laterally elongated, generally elliptical shape. The pickup of the cosmetic 4 (hereinafter also referred to as a cosmetic pickup) by the applying portion 21 is controllable by the hardness ratio of the applying portion 21 and the wiper 31, the size of the wiper orifice, the thickness of the wiper 31, and the like. For example, when the rubber hardness of the wiper 31 is varied with that of the applying portion 21 being fixed, the smaller the rubber hardness of the wiper (i.e., the softer the wiper), the more the amount of deformation of the wiper orifice 31A, and the cosmetic pickup by the applying portion 21 tends to increase as a result. The hardness of each of the applying portion 21 and the wiper 31 is preferably in a range of from 55° to 70° in terms of A scale hardness, while dependent on the thickness and shape of these members. It is more preferred that the difference in hardness between them be small.

Since the applying portion 21 gradually increases in width from the connecting position 24 (where the applying portion 21 connects to the stem 22) to the widest part 21E, a deforming force applied to the applying portion 21 gradually increases to smoothly deform the applying portion 21 into a substantially C-shaped form when the applying portion 21 is withdrawn. When the widest part 21E is located between the tip 21D and the connecting position 24, the retention of the cosmetic 4 in the substantially C-shaped applying portion 21 is further improved.

Since the applying portion 21 gradually decreases in width from the widest part 21E to the tip 21D, a deforming force imposed to the applying portion 21 gradually increases to smoothly deform the applying portion 21 into a substantially C-shaped form with the first side 21A inward when the applying portion 21 is inserted through the wiper orifice 31A. As a result, the applying portion 21, while being inserted, is effectively prevented from being deformed into an unexpected shape other than the substantial C-shape with the first side 21A inward, for example, a substantial C-shape or W-shape with the first side 21 (the applying side) outward or an L- or V-shape resulting from bending along a substantial centerline of the applying portion 21. This is effective in preventing the applying portion 21 from memorizing such an unexpected shape. The deformation into an unexpected shape is caused by application of an improper force to the applying portion 21, and the unexpectedly deformed applying portion 21 is slowly restored to its original shape usually in several tens of minutes. However, if the applying portion 21 having acquired the memory of such an unexpected shape is inserted and then withdrawn for use without an interval, there is a possibility for the applying portion 21 to fail to be deformed with its first side 21A inward, resulting in poor retention of the cosmetic 4. Since the applying portion 21 gradually decreases in width from the widest part 21E to the tip 21D, the applying portion 21 is allowed to be deformed into a substantial C-shape with its first side 21A inward when it is inserted through the wiper orifice 31A as well as when it is withdrawn. Thus, the applying portion 21 is always capable of maintaining good retention of the cosmetic 4 in a stable manner. From this viewpoint, it is preferred that the widest part 21E be at a position away from the tip 21D of a distance of 5% to 95%, more preferably 15% to 85%, of the length (in the direction X) of the applying portion 21.

After the applying portion 21 passes through the wiper orifice 31A, it restores the original shape as shown in FIG. 4(*c*) with no force by the wiper orifice 31A imposed thereto. Accordingly, as the original shape is restored, the cosmetic 4 is spread over the entire area of the first side 21A of the applying portion 21. As a result, the applying portion 21 is able to apply the cosmetic uniformly to the lips, etc. At this time, there is very little retention of the cosmetic on the second side 21B, so that a user can apply the cosmetic quickly at ease without feeling worried about unintentional application to other than the target region. With a conventional simply flattened applicator, adhesion of a cosmetic to the second side 21B is unavoidable, and a user has to use the applicator taking care not to attach the cosmetic on the side 21B to other than the intended target. According to the present embodiment, in contrast, since the applying portion 21 is deformed into a substantial C-shape on contact with the wiper 31, the cosmetic attached to the outer side 21B is wiped off very cleanly. As a result, the amount of the cosmetic adhering to the second side 21B is minimized, so that a user feels free from such a worry.

Making the second side 21B arc-shaped in conformity to the shape of the wiper orifice 31A in a cross-section of the applying portion 21 could be a possible solution to avoid adhesion of the cosmetic to the second side 21B. In that case, however, the applying portion 21 will have a larger thickness particularly in the central portion thereof and a so increased bending strength, which impairs the soft feel of the applying portion when applied to the skin. In using the applicator device 1 of the present invention to apply a lip cosmetic, a hard feeling gives a user great discomfort because the lips are particularly sensitive parts. Moreover, making the second side 21B arc-shaped in conformity to the shape of the wiper orifice 31A puts a limit on the width of the applying portion 21. That is, the width of the applying portion 21 is not allowed to be increased. As a result, the area that is covered by the cosmetic by a single application operation is reduced, and the convenience of use is reduced.

It is possible to vary the retention of the cosmetic 4 by the applying portion 21 by changing the combination of the rubber hardness of the applying portion 21 and the rubber hardness of the wiper 31. In such cases, even though the degree of C-shape deformation changes to change the cosmetic retention by the applying portion 21, the good fact remains that the cosmetic 4 spreads over the entire area of the first side 21A when the applying portion 21 restores its original state after passage through the wiper orifice 31A. The applying portion 21 is thus able to uniformly apply the cosmetic to the lips, and the like.

From the viewpoint of successfully achieving elastic deformation and restoration, the applying portion 21 may be made of various elastomers, such as natural rubber, butadiene rubber, isoprene rubber, nitrile rubber, chloroprene rubber, silicone resins, and polyurethane. A thermoplastic elastomer is preferred because of injection moldability. Making the applying portion 21 of an elastically deformable material is favorable also from the aspect of the feel to the lips, etc.

The applicator device 1 of the present embodiment has an advantage of being useful for cosmetics of a broad range of viscosities. This is because the cosmetic 4 is allowed to pass through the wiper orifice 31A while being embraced by the substantially C-shaped applying portion 21. In the case of a low-viscosity cosmetic, the applying portion of a conventional applicator will be deprived of the cosmetic more than necessary by the wiper, resulting in the failure of retaining a large quantity of the cosmetic.

Figure 5A:
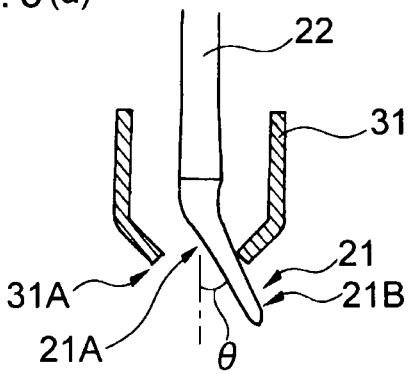
FIG. 5(*a*) and FIG. 5(*b*) each schematically illustrate a side view of the applying portion having a cosmetic attached thereto and being passing through the orifice of the wiper.
Figure 5B:
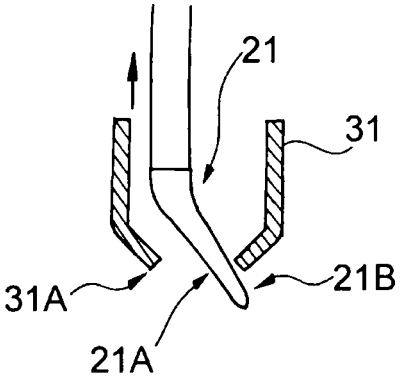

FIGS. 5(*a*) and 5(*b*) schematically illustrate side views of the applying portion 21 being wiped by the wiper 31. FIG. 5(*a*) illustrates the applying portion 21 having been immersed in the cosmetic 4 (see FIG. 1) and pulled up to reach the contact with the wiper 31. As shown, the second side 21B of the applying portion 21 is the first to contact the lip (lower edge) of the wiper orifice 31A. In this state, the axial center of the wiper orifice 31A and the axial center of the stem 22 are coincident with each other.

As the applying portion 21 is further pulled up from the position shown in FIG. 5(*a*), the second side 21B of the applying portion 21 is wiped by the edge of the orifice 31A because of the inclination of the applying portion 21, and the axial center of the stem 22 gradually deviates from the axial center of the orifice 31A. In this manner, as the applying portion 21 is withdrawn, the second side 21B of the applying portion 21 comes into contact with the edge of the wiper orifice 31A and wiped to remove excess of the cosmetic 4 attached to the second surface 21B without fail. Besides, since the second side 21B is in contact with the edge of the wiper orifice 31A, the deforming force by the edge of the orifice 31A is exerted in the direction from the second side 21B toward the first side 21A. It necessarily follows that the applying portion 21 is deformed into a substantial C-shape with the first side 21A inward. In short, withdrawal of the applying portion 21 surely results in the contact of the second side 21B with the edge of the wiper orifice 31A since the applying portion 21 is inclined with respect to the axis of the stem 22 such that the first side 21A may face the bottom of the receptacle 3. While in FIG. 5(*b*) the contact between the second side 21B and the edge of the wiper orifice 31A is depicted as a point contact, the contact is in fact a linear contact because the applying portion 21 is deformed into a substantial C-shape such that the second side 21B forms a convexity having an arc cross-section along the shape of the wiper orifice 31A.

Figure 6:
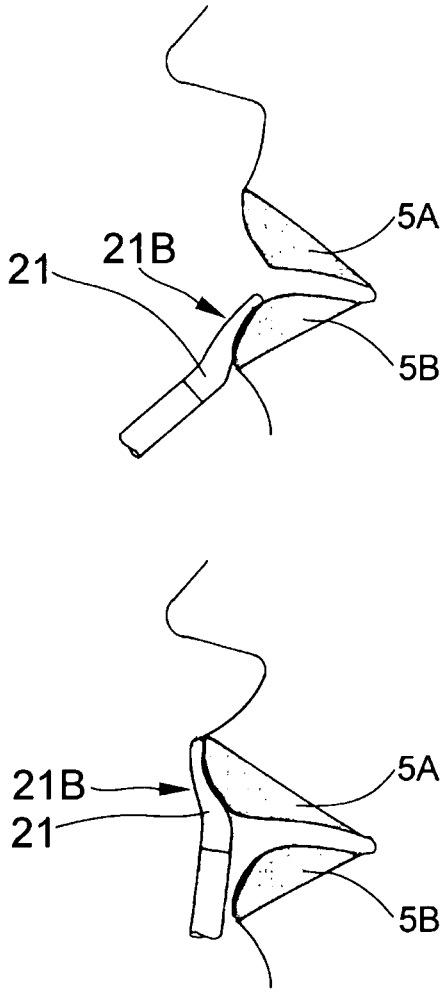
FIG. 6 illustrates an exemplary usage of the cosmetic applicator device shown in FIG. 1.

In order to certainly cause the applying portion 21 to be deformed into a substantial C-shape, the angle θ between the applying portion 21 and the stem 22 (see FIG. 5(*a*)) is preferably 10° to 50°, more preferably 20° to 40°. The angle falling within that range is advantageous in (1) that a user's hand holding the applicator 2 is less likely to touch the user's face as shown in FIG. 6, (2) that withdrawal and insertion of the applicator 2 from and into the receptacle 3 are easily achieved, and (3) that the receptacle 3 can be made small in diameter and compact to carry.

As described, the construction of the applicator 1 according to the present embodiment achieves retention of a given large quantity of the cosmetic 4 simply by wiping the applying portion 21 having picked up the cosmetic 4 by the wiper 31. To further ensure this effect, it is preferred that the ratio of the width of the widest part 21E of the applying portion 21 to the largest width of the wiper orifice 31A be 1.1 to 5.0, more preferably 1.4 to 3.0, before the applying portion 21 is met with the wiper 31, namely before it is deformed. When the ratio is too low, the positional relation between the applying portion 21 and the wiper orifice 31A is liable to vary so that the state of deformation of the applying portion 21 is unstable, which can result in difficulty in retaining a given amount of the cosmetic 4. When the ratio is too high, a large force will be needed to deform the applying portion 21 in a substantial C-shape when the applying portion 21 passes through the wiper orifice 31A, which reduces the convenience of use. When the ratio is extremely high, both side edges of the widest part 21E of the applying portion 21 can meet each other to hinder deformation of the applying portion 21 when the applying portion 21 is deformed into a substantial C-shape, or the side edges of the widest part 21E can overlap with each other to make the deformation state unstable. As a result, it is difficult for the applying portion 21 to retain a given amount of the cosmetic 4 uniformly on its first side 21A.

In addition to the above recited preferred range of the ratio of the width of the widest part 21E of the applying portion 21 to the largest width of the wiper orifice 31A, the largest width of the wiper orifice 31A is preferably 1.0 to 10 mm, more preferably 2.0 to 7.0 mm, in terms of diameter when the orifice 31A is circular. In the present embodiment, even if the size of the wiper orifice 31A is reduced, a large quantity of the cosmetic is retainable on the applying portion 21 by increasing the degree of deformation of the applying portion 21 into a substantial C-shape. To reduce the size of the wiper orifice 31A leads to reduction in diameter of the receptacle 3. To reduce the diameter of the receptacle 3 means a reduced size of the receptacle 3.

The wiper 31 serves to wipe off not only the excess cosmetic 4 attached to the applying portion 21 but also the cosmetic 4 attached to the stem 22. In order to ensure wiping off the cosmetic 4 attached to the stem 22, the ratio of the diameter d1 of the wiper orifice that is circular to the diameter d2 of the stem 22 that is circular in cross-section, d1/d2, is preferably 0.7 to 1.0, more preferably 0.80 to 0.98.

While in the present embodiment the wiper orifice 31A is circular, it may have other than a circular shape, i.e., an anisotropic shape, such as an ellipse or an oblong circle.

FIG. 6 illustrates an exemplary usage of the cosmetic applicator device 1 according to the present embodiment. On withdrawal of the applicator 2 from the receptacle 3, excess of the cosmetic 4 is wiped off from the applying portion 21 by the wiper 31 through the above-mentioned mechanism of action to leave an adequate amount of the cosmetic 4 as retained on the first side 21A of the applying portion 21. The applying portion 21 in this condition is easy for a user to recognize at a glance to have the cosmetic 4 retained thereon. Thus, a user is able to apply only a necessary amount of the cosmetic 4 to an intended region of the skin easily and surely even if it is the first time for the user to use the applicator device. Coloring the applying portion 21 to make a high contrast to the cosmetic 4 will be helpful for a user to recognize the retention of the cosmetic 4. Because the adhesion of the cosmetic 4 to the second side 21B and the stem 22 is very small, a user can apply the cosmetic 4 quickly at ease without feeling worried about unintentional application to a regrion other than the target region, for example, unintentional adhesion of the cosmetic 4 to the upper lip when in applying to the lower lip, or vice versa). In applying the cosmetic 4 to the lips, the applicator is held to have the first side 21A, where the cosmetic 4 is retained, of the applying portion 21 face either the upper lip 5A or the lower lip 5B as shown in FIG. 6. Since the applying portion 21 is inclined with respect to the axis of the stem 22 as previously mentioned, the user's hand holding the applicator 2 is apart from the user's face in applying the cosmetic 4 to either the upper lip 5A or the lower lip 5B. Therefore, the user is able to perform the applying operation in a natural state.

Since the concavity 21C is formed on the concave first side 21A, all the cosmetic 4 retained in the concavity 21C is applicable to the lips because the concave surface provides a snug fit against a lip.

Other embodiments of the applying portion 21 of the lip cosmetic applicator device according to the invention will then be described with reference to FIGS. 7 through 17. The description of the first embodiment applies as appropriate to these embodiments with the exceptions noted hereafter. In FIGS. 7 to 17, the same elements or members as those in FIGS. 1 to 6 are identified with the same reference numerals.

Figure 7A:
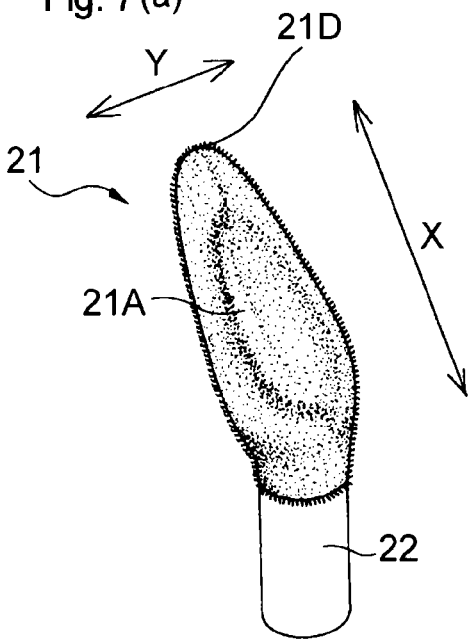
FIG. 7(*a*) and FIG. 7(*b*) are a perspective view and a front view, respectively, of another embodiment of the applying portion.
Figure 7B:
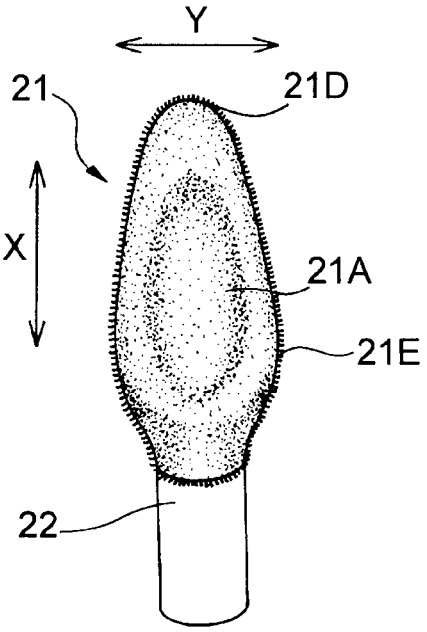

In the embodiment shown in FIGS. 7(*a*) and 7(*b*) the applying portion 21 gradually decreases in width from its widest part 21E to the tip 21D. When the applying portion 21 is viewed from the front, the tip 21D has an arc shape. To have an arc-shaped tip provides the following advantage. The cosmetic 5 is not effectively wiped off from the part of the applying portion 21 where the width of the applying portion 21 is smaller than the diameter of the wiper orifice 31A between the widest part 21E and the tip 21D. Then, by making the tip 21D substantially arc-shaped, the length from the position where the width of the applying portion 21 decreases to smaller than the diameter of the orifice 31A of the wiper 31 to the tip 21D is made shorter. As a result, the amount of the cosmetic 4 attached to and near the tip 21D and remaining non-wiped off is reduced, and adhesion of more cosmetic 4 than necessary to and near the tip 21D is prevented. To have a substantially arc-shaped tip 21D is also advantageous to effectively avoid damage to the skin.

Figure 8A:
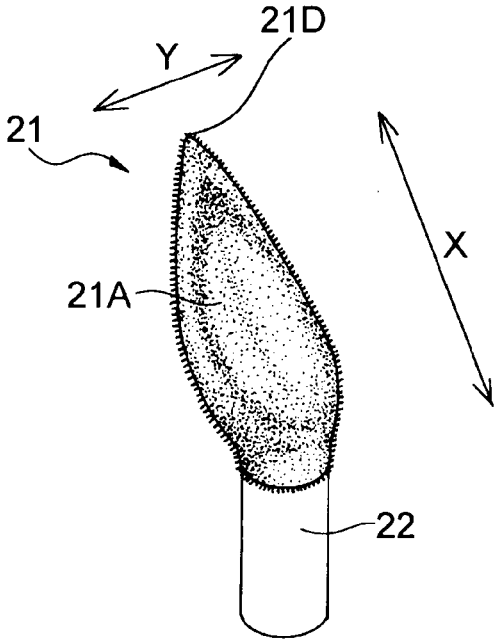
FIG. 8(*a*) and FIG. 8(*b*) are a perspective view and a front view, respectively, of still another embodiment of the applying portion.
Figure 8B:
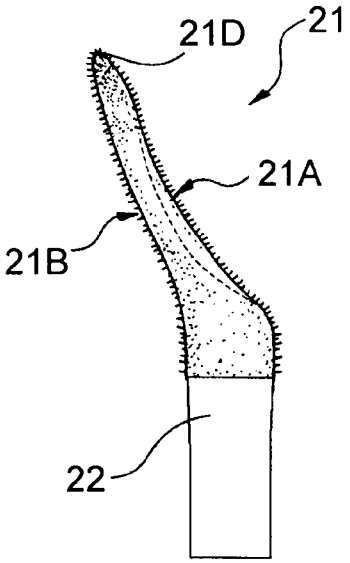

In the embodiment shown in FIGS. 8(*a*) and 8(*b*), the first side 21A of the applying portion 21 has a surface concave in the longitudinal direction X as well as the width direction Y. The first side 21A being concave in the longitudinal direction X, as the applying portion 21 is withdrawn from the receptacle 3 (see FIG. 1) and deformed with its first side 21A inward, the curvature of the first side 21A near the centerline along the longitudinal direction X becomes smaller than that before the passage through the wiper orifice 31A, i.e., approaches zero. After the passage through the wiper orifice 31A, the first side 21A restores the original curvature, whereupon the cosmetic 4 gathers to the central portion in the longitudinal direction X of the first side 21A. The applying portion 21 in that condition is capable of applying a larger amount of the cosmetic to the central portion of a target region than the other portion of the target region. This is suitable in the case, for example, when a user wants to add more gloss to the central portion of the lip to be made up. To have the first side 21A concave in both the longitudinal direction X and the width direction Y is taken advantage of in facilitating setting the curvature of the first side 21A close to that of a target region, for example, that of the lips, thereby to improve the fit and ease of application to the target region.

Figure 9:
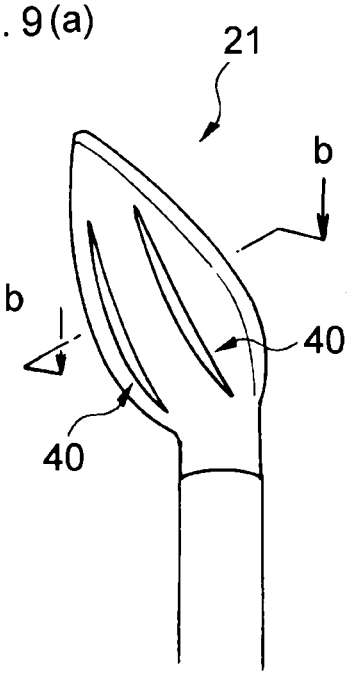
FIG. 9(*a*) is a perspective view of yet another embodiment of the applying portion.
Figure 9:
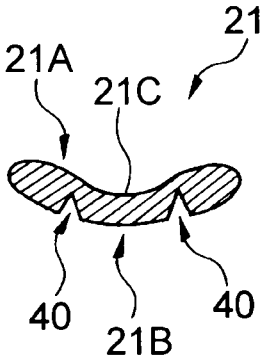
Figure 9:
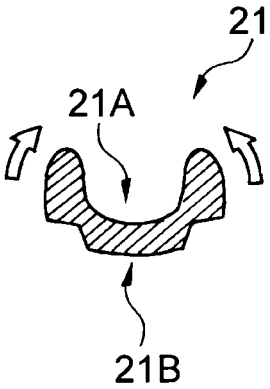
Figure 10A:
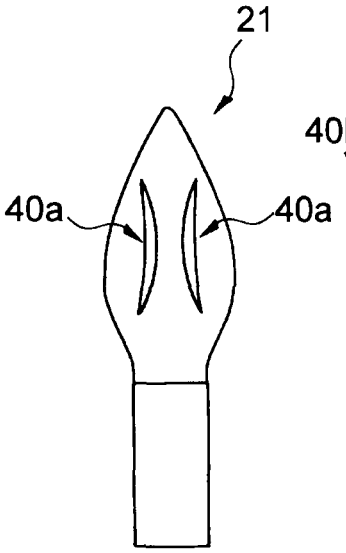
FIG. 10(*a*), FIG. 10(*b*), FIG. 10(*c*), FIG. 10(*d*), and FIG. 10(*e*) illustrate other embodiments of the applying portion.
Figure 10B:
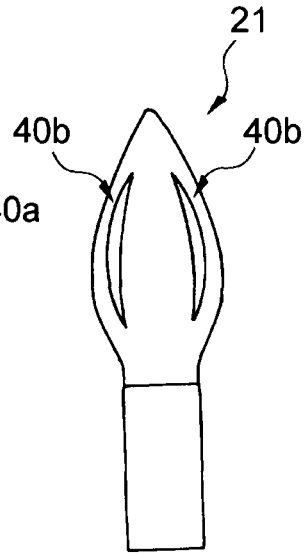
Figure 10C:
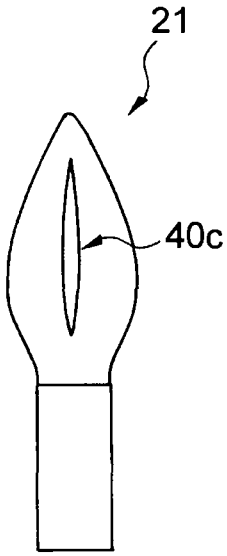
Figure 10D:
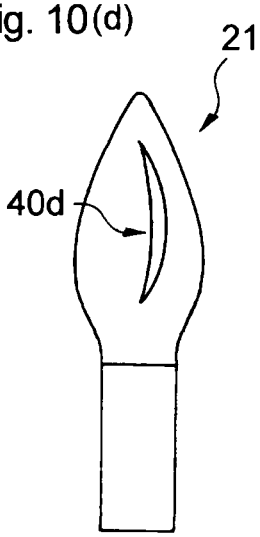
Figure 10E:
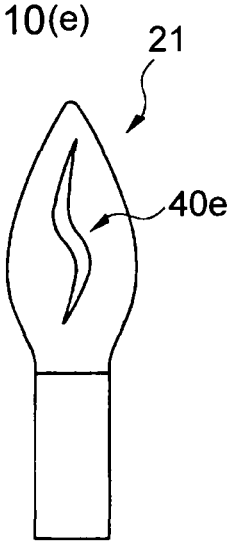

In the embodiment shown in FIGS. 9(*a*) and 9(*b*), the applying portion 21 has a plurality of (two in the particular case illustrated) straight or curved grooves 40 extending in its longitudinal direction on its second side 21B opposite to the first side 21A (applying side). The two grooves 40 are symmetric about the longitudinal centerline of the applying portion 21. The two grooves 40 act as deformation inducing lines when the applying portion 21 is deformed into a substantial C-shape. That is, when the applying portion 21 shown in FIG. 9(*b*) passes through the wiper orifice 31A, deformation of the applying portion 21 starts at the positions of the grooves 40 and proceeds as shown in FIG. 9(*c*). The deformation inducing lines allow for variation of the degree of deformation into a substantial C-shape, namely, retention of the cosmetic 4 without altering the shape or width of the first side 21A which is influential on the ease of cosmetic application. The deformation inducing lines also reduce the force needed to deform the applying portion 21 into a substantial C-shape to reduce the resistance during withdrawal and insertion, thereby improving the convenience of use. Furthermore, the deformation inducing lines help the convex portions surrounding the concavity of the first side 21A to be deformed in the directions opposite to the directions arrowed in FIG. 9(*c*) when the first side 21 A is pressed against a target region. As a result, the applying side feels softer on the target region, and the concavity gets shallower to release the cosmetic 4 retained in the concavity to the target region more easily. While the cross section along the direction Y is easy to deform because of the grooves 40 that extend in the longitudinal direction of the applying portion 21, the presence of the grooves 40 has no influence on the deformation of the cross section along the direction X or rather hinders the deformation in the X direction when the applying portion 21 is applied to a target region and being deformed in the direction Y. This means that the position of the tip of the applying portion 21 relative to the stem 22 does not change with the presence or absence of the deformation inducing lines or is less likely to change than with the absence of the deformation inducing lines. Therefore, the position of the tip of the applying portion 21 is not varied during cosmetic application, which is advantageous in applying the cosmetic to a small target region. To obtain noticeable effects of the deformation inducing lines, the length of the grooves 40 is preferably 30% to 100%, more preferably 75% to 95%, of the length of the applying portion 21. Each groove may be either continuous or discontinuous (e.g., a line of depressed dots).

The shape of the groove shown in FIG. 9(*a*) may be varied as shown in FIGS. 10(*a*) through 10(*e*). In the embodiment of FIG. 10(*a*), two grooves 40*a* are provided symmetrically about the longitudinal centerline of the applying portion 21. Each groove 40*a* is convex toward the longitudinal centerline of the applying portion 21. In the embodiment of FIG. 10(*b*), two grooves 40*b* are provided symmetrically about the longitudinal centerline of the applying portion 21. Each groove 40*b* is convex toward the side of the applying portion 21. In the embodiment shown in FIG. 10(*c*), one straight groove 40*c* is provided at the position of the longitudinal centerline of the applying portion 21. In the embodiment shown in FIG. 10(*d*), one curved groove 40*d* is formed at the position of the longitudinal centerline of the applying portion 21. In the embodiment shown in FIG. 10(*e*), one wavy groove 40*e* is provided at the position of the longitudinal centerline of the applying portion 21. The deformation of the applying portion 21 varies in condition and degree according to the shape, position, and number of the grooves. It is therefore possible to adjust the retention and distribution of the cosmetic 4 on the first side 21A by these factors. The shape, position, and number of the grooves may be decided as appropriate to a desired retention of the cosmetic 4 on the applying portion 21. Or the shape and position of the grooves may be decided as appropriate so as to result in such a non-uniform cosmetic distribution on the first side 21A (for example, a larger cosmetic 4 distribution on the center of the first side 21A than on the periphery thereof) that will add a dimension to the makeup, for example, add more gloss to the central portion of the lips to create a plumper appearance.

Figure 11:
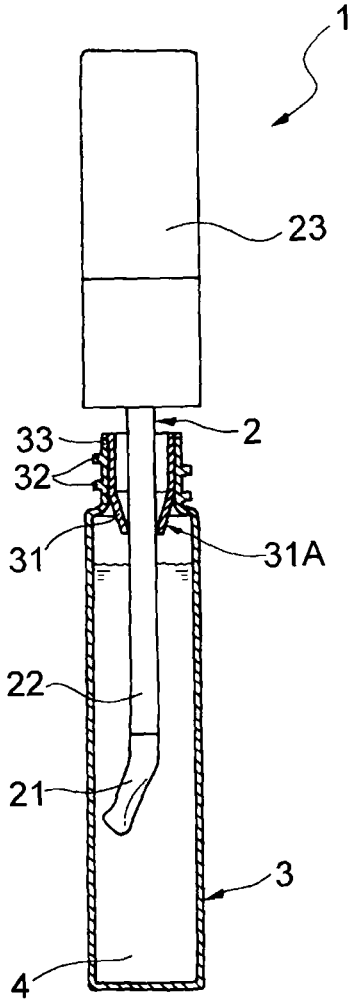
FIG. 11 is a front view with a part cut away of another embodiment of the lip cosmetic applicator device according to the invention.
Figure 12A:
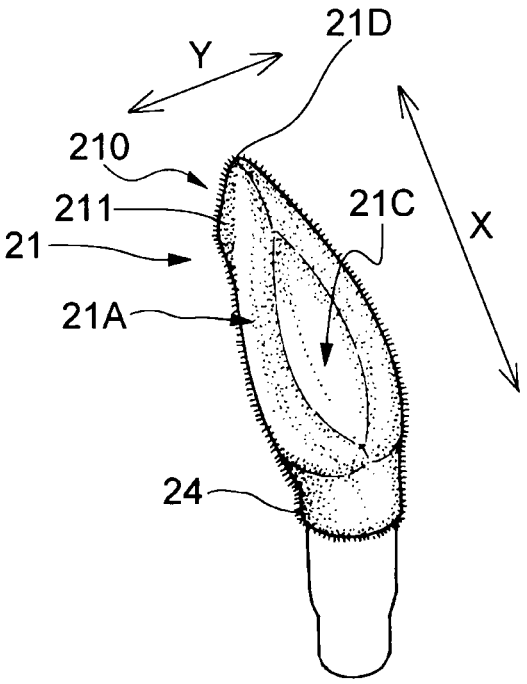
FIG. 12(*a*) and FIG. 12(*b*) are enlarged perspective views of the applying portion of the lip cosmetic applicator device shown in FIG. 11 seen from the applying side and the opposite side, respectively.
Figure 12B:
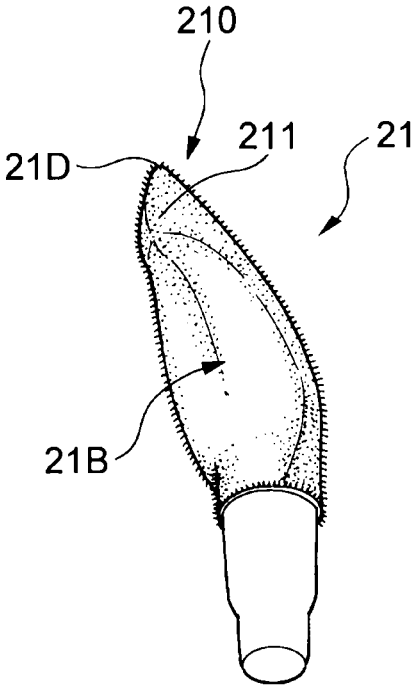
Figure 13A:
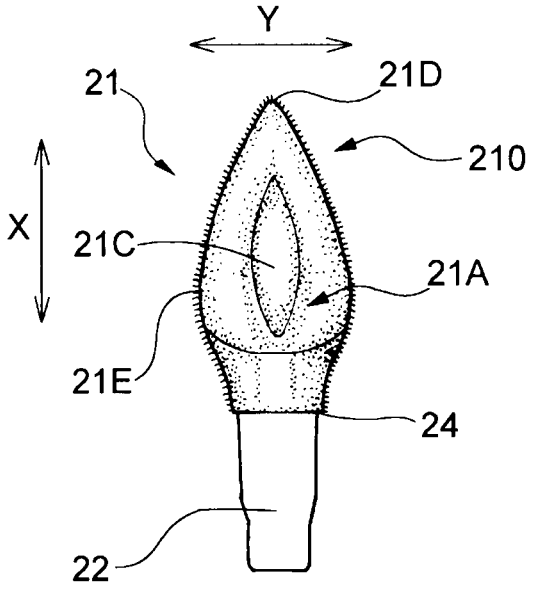
FIG. 13(*a*) and FIG. 13(*b*) are a front view and a side view, respectively, of the applying portion of the lip cosmetic applicator device shown in FIG. 11.
Figure 13B:
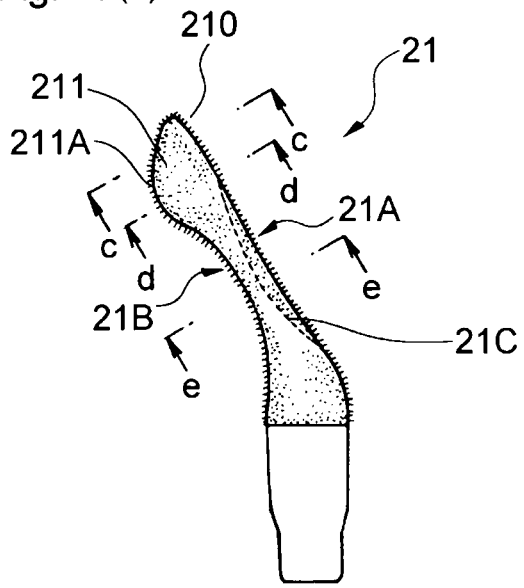
Figure 13C:
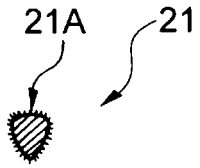
Figure 13D:
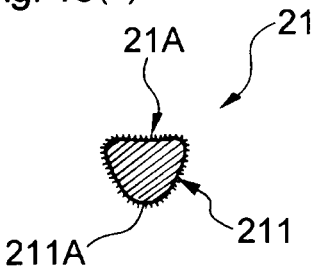
Figure 13E:
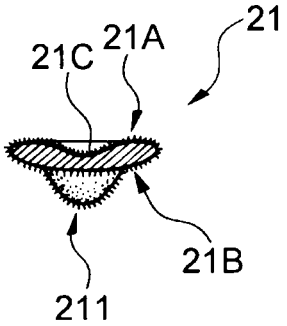

FIG. 11 presents another embodiment of the lip cosmetic applicator device 1 of the invention. FIGS. 12(*a*) and 12(*b*) are enlarged views of the applying portion 21 of the applicator device 1 of FIG. 11. In FIGS. 12(*a*) and 12(*b*) the applying portion 21 is depicted upside down relative to that in FIG. 11. As shown in FIGS. 12(*a*) and 12(*b*), the applying portion 21 has a flattened body. The applying portion 21 is longer than wide, having a longitudinal direction X coincident with the longitudinal direction of the stem and a width direction Y perpendicular to the longitudinal direction X.

The flattened, longer-than-wide applying portion 21 has a first side 21A that is an applying side and a second side 21B opposite to the first side. The first side 21A has a concave surface, while the second side 21B has a flat or slightly convex surface.

FIGS. 13(*a*) through 13(*e*) present a front view, a side view, and transverse cross-sectional views of the applying portion 21 shown in FIGS. 12(*a*) and 12(*b*). As can be seen from FIGS. 13(*a*) to 13(*e*) and FIGS. 12(*a*) and 12(*b*), the overall outer surface of the applying portion 21 before being covered in flocking is defined by curved surfaces, except for the tip. In other words, the applying portion 21 before being flocked has a smooth surface with no angular parts except the tip.

One of the characteristics of the applicator device 1 of the present embodiment is that the tip portion 210 of the applying portion 21 of the applicator 2 has a larger thickness than the widest part 21E of the applying portion 21. In detail, the tip portion 210 has a protrusion 211 on the second side 21B opposite to the applying side, i.e., the first side 21A and therefore has an increased thickness. As used herein, the term "thickness" is defined to be the size of the applying portion 21 in a plane containing the longitudinal direction of the applying portion and perpendicular to the first side 21A (the applying side of the applying portion 21).

The above described shape of the applying portion 21 produces an advantageous effect that dripping and threading of the cosmetic is effectively prevented without impairing ease of applying the cosmetic to, for example, the ends of the lips. This advantageous effect will be explained by way of FIG. 14.

Figure 14A:
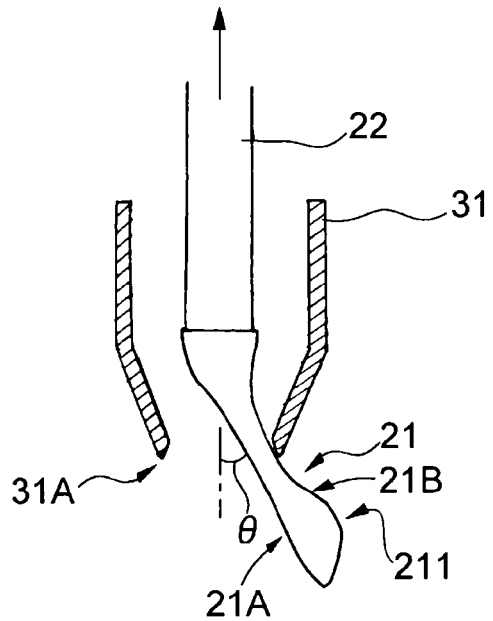
FIG. 14(*a*) is a schematic side view of the applying portion having a cosmetic attached thereto and being passing through the orifice of a wiper.
Figure 14B:
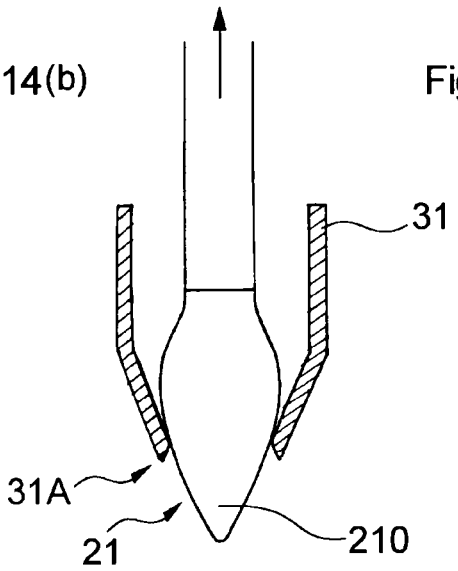
Figure 14C:
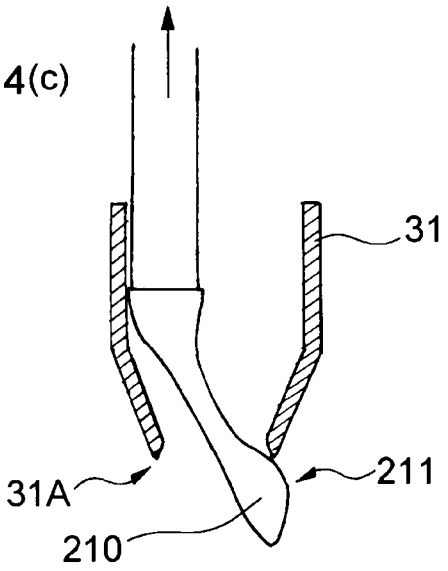

FIG. 14(*a*) illustrates a side view of the applying portion 21 being wiped by the wiper 31. FIG. 14(*a*) illustrates the applying portion 21 having been immersed in the cosmetic 4 (see FIG. 11) and pulled up to reach the contact with the wiper 31. As shown, the second side 21B of the applying portion 21 is the first to contact the edge of the wiper orifice 31A. In this state, the axial center of the wiper orifice 31A and the axial center of the stem 22 are coincident with each other.

As the applying portion 21 is further pulled up from the position shown in FIG. 14(*a*), the second side 21B of the applying portion 21 is wiped by the edge of the orifice 31A because of the inclination of the applying portion 21, and axial center of the stem 22 gradually deviates from the axial center of the orifice 31A. In this manner, as the applying portion 21 is withdrawn, the second side 21B of the applying portion 21 comes into contact with the edge of the wiper orifice 31A and wiped to certainly remove excess of the cosmetic 4 attached to the second surface 21B. Moreover, since the tip portion 210 of the applying portion 21 is tapered to the very tip, the tip portion 210 becomes in less contact with the edge of the orifice 31A of the wiper 31 with further withdrawal of the applying portion 21 as shown in FIG. 14(*b*). That is, it becomes less easy to wipe off excess of the cosmetic. Nonetheless, even though the tip portion 210 is tapered, the presence of the thick protrusion 211 in the tip portion 210 secures the contact between the second side 21B of the tip portion 210 and the edge of the wiper orifice 31A as shown in FIG. 14(*c*), the wiper 31 continues to be deformed, and the tip portion 210 of the applying portion 21 moves in a direction toward the applying side 21A (to the left in FIG. 14(*c*)) more largely than in the case of an applying portion 21 having no protrusion 211. The movement of the tip portion 210 in the direction of the applying side 21A is accompanied in some cases with parallel movement or change in angle of the whole applying portion 21 involving the stem 22 and in other cases with elastic deformation of the applying portion 21 to result in reduction of the angle θ, which depends on the user's way of withdrawing the applying portion 21. In any case, the tip portion 210 certainly moves in the direction toward the applying side 21A.

As a result of the movement of the tip portion 210 in the direction toward the applying side 21A, the gap between the applying side 21A and the edge of the wiper orifice 31A decreases, so that the amount of the cosmetic 4 attached around the tip portion 210 is reduced. When, in particular, the applying portion 21 is inclined with respect to the axis of the stem 22 such that the first side 21A may face the bottom of the receptacle 3, there is usually a strong tendency for a large gap to be left between the applying side 21A and the edge of the wiper orifice 31A, so that the wiping effect in removing the cosmetic 4 off the applying side 21A of the tip portion 210 is weaker than that obtained with the applying portion that is not inclined. In the present invention, however, an enhanced wiping effect is obtained to successfully remove excess of the cosmetic 4.

Without the protrusion 211, the applying portion might fail to have the excess cosmetic wiped off neatly from its lateral sides at a position having a smaller width than the diameter of the orifice. In contrast, as the tip portion 210 moves in the direction toward the applying side 21A because of the protrusion 211, the positions of the contact points between the lateral sides of the applying portion 21 and the edge of the orifice 31A also move. It follows that the lateral sides of the applying portion 21 come into contact with parts of the edge of the wiper orifice 31A at other than the positions of the edge providing the largest diameter of the orifice 31A, so that the cosmetic 4 may be wiped also from the lateral sides at positions having a smaller width than the orifice diameter. That is, excess cosmetic 4 is wiped off from the lateral sides of the applying portion gradually decreasing in width even at a position closer to the tip 21D when the portion gradually decreasing in width is provided with the protrusion 211 than when no such protrusion 211 is provided.

Thus, excess cosmetic 4 can be wiped off from all the surfaces of the tip portion 210 including the periphery of the protrusion 211, the applying side 21A, and the lateral sides of the applying portion 21 until just before completion of the withdrawal of the applying portion 21.

In particular, since the tip portion 210 in the present embodiment has an increased thickness due to the protrusion 211 on the side 21B opposite to the first side 21A, dripping or threading of the cosmetic is prevented effectively without hindering fine makeup finish with the tip 21D. As shown in FIGS. 13(*c*) and 13(*d*), the tip portion 210 is triangular with rounded corners in a cross-section along the width direction Y of the applying portion 21. Accordingly, the tip portion 210 has two planes in addition to the applying side. The two additional planes are convenient to apply the cosmetic to a small region, such as the ends of a lip, or to go over the lip cosmetic previously applied.

The thickness of the tip portion 210 having the protrusion 211 gradually increases from its tip 21D toward the proximal end of the applying portion 21 until a thickest part 211A is formed and then gradually decreases from the thickest part 211A toward the proximal end, approaching to the thickness of the widest part 21E. Having the so-configured protrusion 211, the applying portion 21 is easy to withdraw from or insert into the receptacle 3 through the wiper 31 and is less likely to undergo damage to the flocking on the applying portion 21 even on repeating withdrawal and insertion many times.

Besides having the protrusion 211 in the tip portion 210 of the applying portion 21, the applicator 2 has another characteristic in terms of the relation between the width of the widest part 21E of the applying portion 21 and the size of the wiper orifice 31A of the wiper 31. In detail, the widest part 21E is wider than the widest part of the orifice 31A. Accordingly, when the applicator 2 shown in FIG. 11 is withdrawn from the receptacle 3, the widest part 21E of the applying portion 21 catches in the wiper orifice 31A of the wiper 31. In the present embodiment, the applying portion 21 is made of an elastically deformable material so that it may be deformed upon the widest part 21E catching in the wiper orifice 31A so as to be capable of passing through the wiper orifice 31A. The applying portion 21 is configured to be deformed to make a substantial C-shape with the first side 21A inward. The advantages obtained by such a way of deformation are as explained with reference to FIG. 4. According to the present embodiment, in particular, since the second side 21B comes into contact with the edge of the wiper orifice 31A when the applying portion 21 is withdrawn, the deforming force by the edge of the orifice 31A is exerted from the second side 21B toward the first side 21A. It follows that the applying portion 21 is always deformed into a substantial C-shape with the first side 21A inward as has been discussed with reference to FIG. 4(*b*).

Since the applying portion 21 gradually decreases in width from the widest part 21E to the tip 21D, the applying portion 21 is allowed to be deformed into a substantial C-shape with its first side 21A inward when it is inserted through the wiper orifice 31A as well as when it is withdrawn. Thus, the applying portion 21 is always capable of maintaining good retention of the cosmetic 4 in a stable manner. The same effect is produced by the protrusion 211. That is, since the tip portion 210 has its thickness gradually increased from its tip 21D toward the proximal end of the applying portion 21 to form the thickest part 211A, the applying portion 21 is effectively prevented from being deformed in an unexpected shape and is thereby capable of maintaining good retention of the cosmetic 4 in a stable manner.

In order that the deforming force by the edge of the wiper orifice 31A may be exerted in the direction from the second side 21B toward the first side 21A of the applying portion 21 with the second side 21B being in contact with the edge of the wiper orifice 31A, it is advantageous that the applying portion 21 is inclined with respect to the axis of the stem 22 such that the first side 21A thereof faces the bottom of the receptacle 3. To surely cause the applying portion 21 to be deformed into a substantial C-shape, the angle θ between the applying portion 21 and the stem 22 (see FIG. 5(*a*)) is preferably 10° to 50°, more preferably 20° to 40°.

As described, the construction of the applicator 1 according to the present embodiment makes it possible for the applying portion 21 to retain a given large quantity of the cosmetic 4 without inconveniences, such as dripping or threading, simply by wiping the applying portion 21 having picked up the cosmetic 4 by the wiper 31. To further ensure this effect, it is preferred that the ratio of the width of the widest part 21E of the applying portion 21 to the width of the widest part of the wiper orifice 31A be 1.1 to 5.0, more preferably 1.4 to 3.0, before the applying portion 21 is met with the wiper 31, namely before it is deformed.

In that connection, it is preferred that the ratio of the thickness of the thickest part 211A of the projection 211 in the tip portion 210 of the applying portion 21 to the width of the widest part of the wiper orifice 31A be 0.3 to 2.0, more preferably 0.5 to 1.5.

In addition to the above recited preferred ranges of the ratio of the width of the widest part 21E of the applying portion 21 to the width of the widest part of the wiper orifice 31A and the ratio of the thickness of the thickest part 211A of the projection 211 to the width of the widest part of the wiper orifice 31A, the width of the widest part of the orifice 31A is preferably 1.0 to 10 mm, more preferably 2.0 to 7.0 mm, in terms of diameter when the orifice 31A is circular. In the present embodiment, even if the size of the wiper orifice 31A is reduced, a large quantity of the cosmetic is retainable on the applying portion 21 by increasing the degree of deformation of the applying portion 21 into a substantial C-shape. To reduce the size of the wiper orifice 31A leads to reduction in diameter of the receptacle 3. To reduce the diameter of the receptacle 3 means a reduced size of the receptacle 3.

Figure 15:
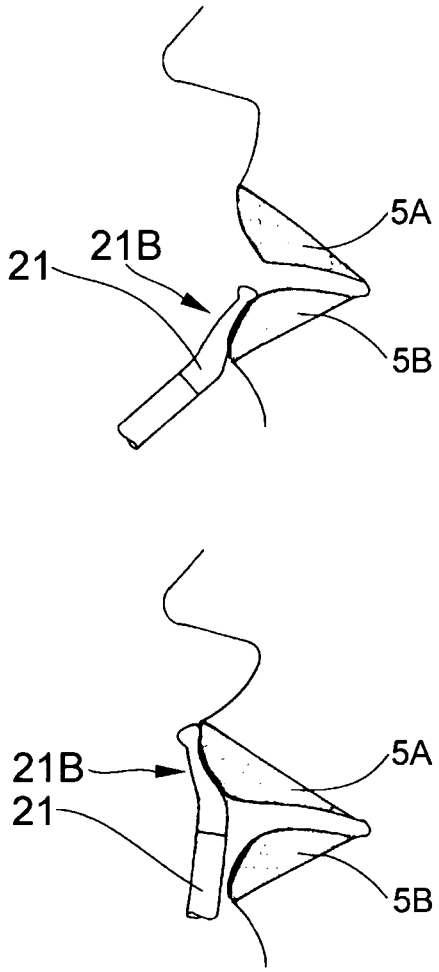
FIG. 15 illustrates an exemplary usage of the lip cosmetic applicator device shown in FIG. 11.

An exemplary usage of the applicator device 1 of the present embodiment is shown in FIG. 15. This usage is the same as described with reference to FIG. 6. The present embodiment provides the advantageous effect that excess of the cosmetic 4 is wiped off from the applying portion 21 by the wiper 31 to leave an adequate amount of the cosmetic 4 as retained on the first side 21A of the applying portion 21. In addition to this effect, there is obtained another advantage that dripping or threading of the cosmetic 4 is prevented.

Figure 16A:
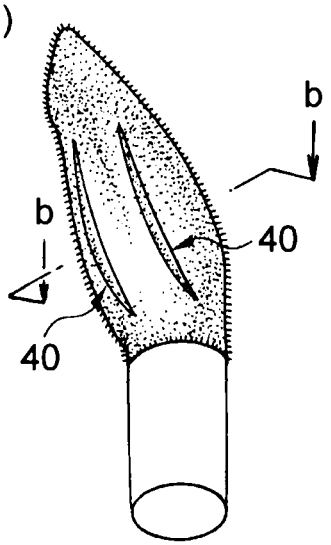
FIG. 16(*a*) is a perspective view of another embodiment of the applying portion.
Figure 16B:
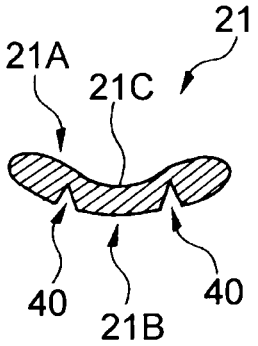
Figure 16C:
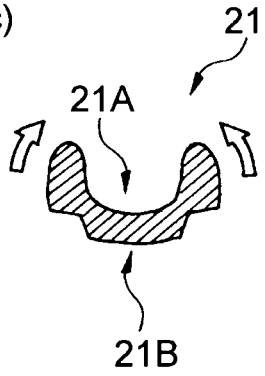
Figure 17A:
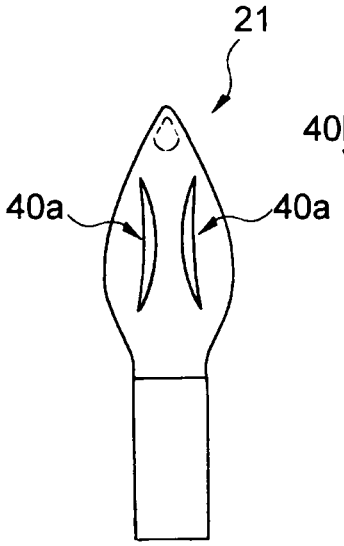
FIG. 17(*a*), FIG. 17(*b*), FIG. 17(*c*), FIG. 17(*d*), and FIG. 17(*e*) illustrate other embodiments of the applying portion.
Figure 17B:
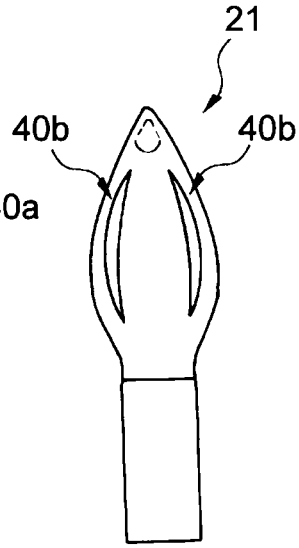
Figure 17C:
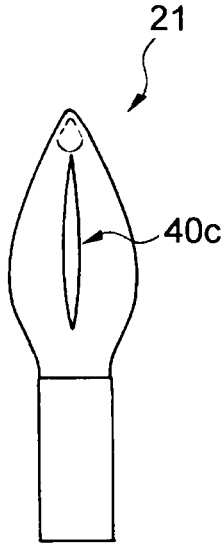
Figure 17D:
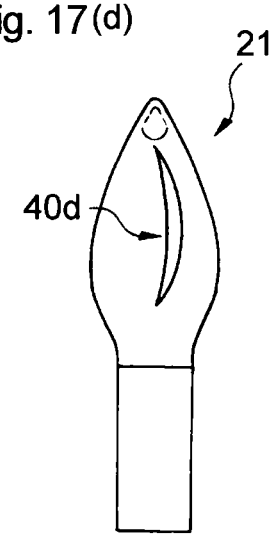
Figure 17E:
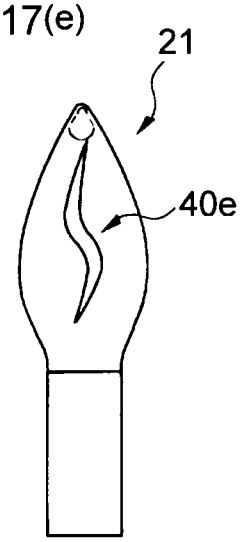

Another embodiment of the applying portion 21 is shown in FIGS. 16(*a*) and 16(*b*). The applying portion 21 of the embodiment shown in these figures has a plurality of (two in the particular case shown) straight or curved grooves 40 extending in its longitudinal direction on its second side 21B opposite to the first side 21A (applying side). The same description about the applying portion having the grooves 40 as given above with reference to FIGS. 9(*a*) through 9(*c*) applies to the grooves 40 of FIG. 16.

The shape of the groove shown in FIG. 16(*a*) may be varied as shown in FIGS. 17(*a*) through 17(*e*). The same descriptions about the shapes shown in FIGS. 10(*a*) through 10(*e*) apply to those shown in FIGS. 17(*a*) through 17(*e*).

Other embodiments of the receptacle 3 used in the lip cosmetic applicator device of the invention will be described by way of FIGS. 18 through 26. The description of the embodiment mentioned above applies as appropriate to the other embodiments with the exceptions noted hereafter. In FIGS. 18 through 26, the same elements or members as those in FIGS. 1 to 17 are identified with the same reference numerals.

Figure 18A:
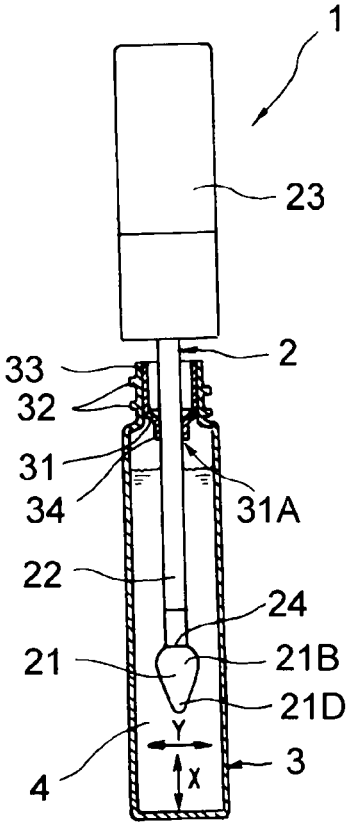
FIG. 18(*a*) is a front view with a part cut away of still another embodiment of the lip cosmetic applicator device according to the invention.
Figure 18B:
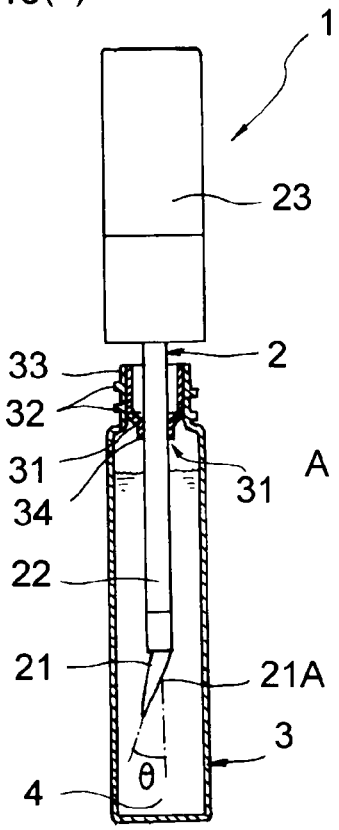

The lip cosmetic applicator device 1 of the embodiment shown in FIG. 18 includes a receptacle 3 containing a cosmetic 4 and an applicator 2 composed of a stem 22 and a flattened applying portion 21 wider than the stem 22 connected to one end of the stem 22. The applicator device 1 is configured such that the applicator 2 having its applying portion 21 immersed in the cosmetic 4 is withdrawn from the receptacle 3 and the applying portion 21 is applied to the user's lips, and the like. The receptacle 3 has a flexible wiper 31 near its neck 33. The wiper 31 has a wiper orifice 34A and is integrally provided with a flexible annular lip 34 that extends downward from the edge of the flexible wiper orifice 31A.

In the present embodiment, the flexible annular lip 34 is integral with the flexible wiper 31 and extends downward from the edge of the wiper orifice 31A. The flexible annular lip 34 is made of an elastically deformable material, such as rubber, similarly to the flexible wiper 31. The flexible annular lip 34 exhibits flexibility allowing its opening shape to be deformed easily such that, for example, the shape of the opening at the lower end of the lip and the shape of the opening at the upper end of the lip, i.e., the connecting part where the lip connects to the wiper orifice 31A may differ. The flexible annular lip 34 preferably extends straight downward in parallel with the axis of the cylindrical receptacle 3 but may extend downward with slight deviation from parallelism to the axis of the receptacle 3 either inward or outward as far as the function of the flexible annular lip 34 is not impaired. The flexible annular lip 34 may extend downward while being curved or bent as will be described later. The flexible annular lip 34 may be designed to be easily deformable in a prescribed direction by providing a thin-walled portion or a cutout in a part thereof as will be described later.

In the present embodiment, it is preferred that the ratio of the diameter of the wiper orifice 31A to the outer diameter of the stem 22 measured at the connecting position 24 (where the stem connects to the applying portion 21), ((diameter of the wiper orifice 31A)/(outer diameter of the stem 22 at the connecting position 24 connecting to the applying portion 21)) be 0.7 to 1.0 and that the ratio of the length of the flexible annular lip 34 to the length of the applying portion 21, ((length of the flexible annular lip 34)/(length of the applying portion 21)), be 0.05 to 0.5. When (diameter of the wiper orifice 31A)/(outer diameter of the stem 22 at the connecting position 24 connecting to the applying portion 21) and (length of the flexible annular lip 34)/(length of the applying portion 21) are within the respective ranges recited, the resistance the applying portion 21 meets during withdrawal or insertion will be reduced, thereby allowing the stem and the applying portion to be wiped in an effective manner with good feel when used and reduced damage to the applying portion and the wiping members. When the wiper orifice 31A and the cross-section of the stem 22 are circular, the term "diameter" or "the outer diameter" of the orifice or the stem, respectively, means what is literally meant by the term. When the wiper orifice 31A or the cross-section of the stem 22 has a shape other than a circle, the term refers to twice the radius of gyration of the shape.

Figure 19A:
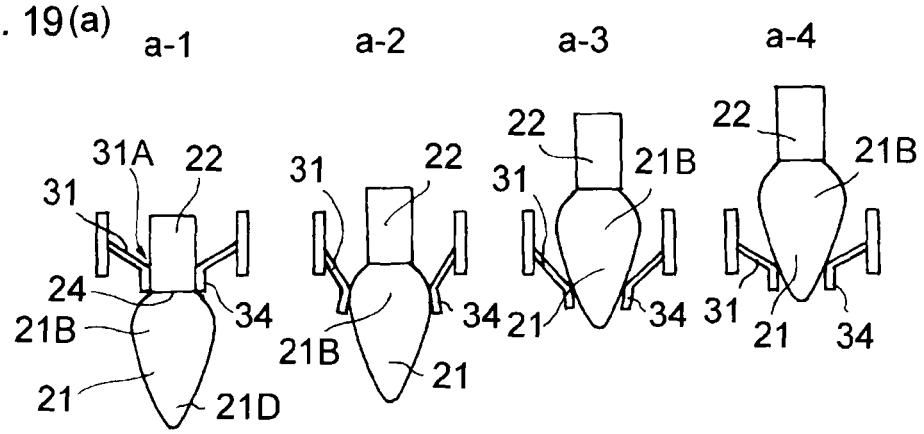
FIG. 19 (*a*) and FIG. 19(*b*) present schematic front and side views, respectively, of the applying portion of the applicator being wiped by a flexible wiper.
Figure 19B:
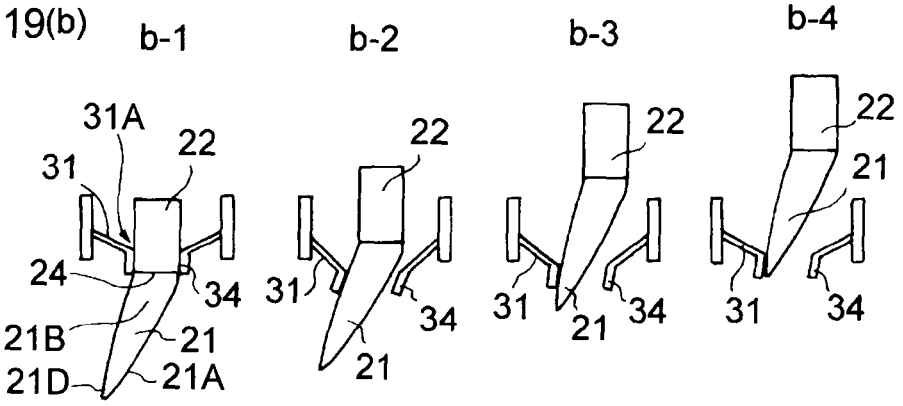
Figure 19C:
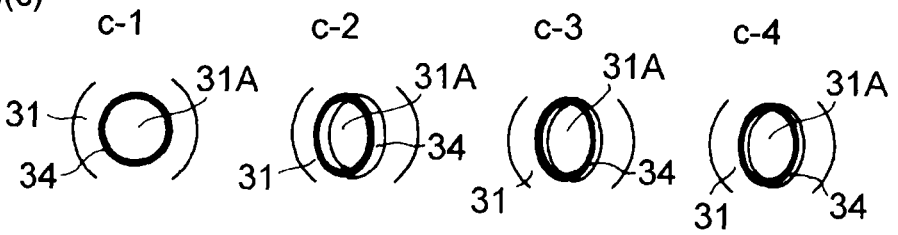

FIG. 19(*a*) presents front views of the flexible wiper 31 wiping the applying portion 21. FIG. 19(*b*) presents side views of the flexible wiper 31 wiping the applying portion 21. FIG. 19(*c*) presents bottom views of the flexible wiper 31 wiping the applying portion 21 with the applying portion 21 omitted. In FIG. 19(*c*) the thick line loop in the middle of each view indicates the shape of the opening at the lower end of the flexible annular lip 34, and the thin line loop in the middle of each view indicates the shape of the opening at the upper end of the flexible annular lip 34.

In the FIGS. 19(*a*), 19(*b*), and 19(*c*), a-1, b-1, and c-1 show the state in which the applying portion 21 having been immersed in the cosmetic 4 (see FIG. 18) is pulled up to reach the flexible wiper 31. In this state, the opening of the flexible annular lip 34 remains non-deformed (i.e., circular) at both the upper end where the lip 34 connects to the flexible wiper 31 and the lower end (free end).

In the FIGS. 19(*a*), 19(*b*), and 19(*c*), a-2, b-2, and c-2 show the state in which the applying portion 21 is further pulled up to have its widest part 21E located inside the flexible annular lip 34. In this state, since the width of the applicator 21 is larger than the diameter of the wiper orifice 31A of the flexible wiper 31, the applying portion 21 widens the wiper orifice 31A in its width direction thereby to deform the shape of the wiper orifice 31A and the shape of the opening at the upper end of the flexible annular lip 34, which is continuous with the orifice 31A, into an elliptic shape. The lower end of the flexible annular lip 34, which is a free end and therefore more flexibly deformable than the upper end, is deformed into a more flattened elliptic shape than the deformed shape of the opening defined by the upper end. As a result, the portion gradually decreasing in width of the applying portion 21 distal from the widest part 21E easily comes into contact with the flexible annular lip 34 having thus deformed to provide a flattened opening and is wiped effectively as shown in a-3, b-3, c-3 and a-4, b-4, and c-4.

While in the present embodiment the applying portion 21 is connected to the stem 22 with an angle of inclination, the flexible annular lip 34 is readily deformed obliquely toward the direction of inclination as the applying portion 21 is withdrawn. Thus, the applying portion 21 is smoothly withdrawn while being wiped without being met with extreme resistance.

Because of the inclination, the back side of the applying portion 21 is always in contact with the flexible annular lip 34 during the withdrawal and is therefore successfully wiped to remove almost all the cosmetic therefrom. On the other hand, a gap is created between the applying side 21A and the flexible annular lip 34 to allow the cosmetic to remain on the applying side 21A. However, since the flexible annular lip 34 is also inclined in conformity to the inclination of the applying portion 21, the gap decreases seemingly to provide an enhanced wiper effect. It is thus possible for the applying portion 21 gradually decreasing in width to be wiped off effectively thereby preventing excess cosmetic from pooling in the tip of the applying portion 21.

Having the above described configuration, the applicator device 1 of the present embodiment can have the flexible annular lip 34 deformed to reduce the resistance when the applying portion 21 is withdrawn or inserted as compared with a device having a merely reduced wiper orifice diameter. The applicator device 1 thus achieves effective wiping of the wide and flattened applying portion 21 with reduced damage to the applying portion 21.

The larger the length of the flexible annular lip 34, the higher the wiper effect. In general, a reduced diameter of the wiper orifice 31A brings about an enhanced wiper effect. However, if the diameter of the orifice 31A is so small as to cause excessive frictional resistance during withdrawal, the convenience of use may be impaired, or the applying portion 21 may be damaged. Furthermore, the excessive frictional resistance overly deforms the flexible wiper 31 in an unstable mode. It could follow that the cosmetic pickup per withdrawal varies largely, which also impairs the convenience of use.

The cosmetic pickup by the applying portion 21 is adjustable by the hardness ratio of the applying portion 21 to the flexible annular lip 34 and the size and thickness of the flexible annular lip 34. For example, when the applying portion 21 has the shape shown in FIG. 18 and the concavity in the center of the first side 21A, and rubber hardness of the flexible annular lip 34 is varied with that of the applying portion 21 being fixed, as the rubber hardness of the flexible annular lip 34 reduces (i.e., as the flexible annular lip 34 becomes softer), there will be a tendency that the degree of deformation of the wiper orifice 31A from a substantial circle to a substantial ellipse increases, that the degree of deformation of the applying portion 21 into a substantial C-shape with the applying side 21A inward decreases, and that the cosmetic pickup by the applying portion 21 increases. Conversely, as the rubber hardness of the flexible annular lip 34 increases (i.e., as the flexible annular lip 34 becomes harder), there will be a tendency that the degree of deformation of the wiper orifice 31A from a substantial circle to a substantial ellipse decreases and that the degree of deformation of the applying portion 21 into a substantial C-shape with the applying side 21A inward increases. It would follow that the area of the gap between the applying portion 21 and the wiper orifice 31A in a transverse cross-section (perpendicular to the direction X) decreases, resulting in a reduced cosmetic pickup by the applying portion 21. The hardness of each of the applying portion 21 and the flexible annular lip 34 is preferably in a range of from 55° to 70° in terms of A scale hardness, while dependent on the thickness and shape of these members. It is more preferred that the difference in hardness between them be small.

The applying portion 21 and the flexible annular lip 34 may be made of various elastomers, such as natural rubber, butadiene rubber, isoprene rubber, nitrile rubber, chloroprene rubber, silicone resins, and polyurethane. A thermoplastic elastomer is preferred because of injection moldability.

Figure 20A:
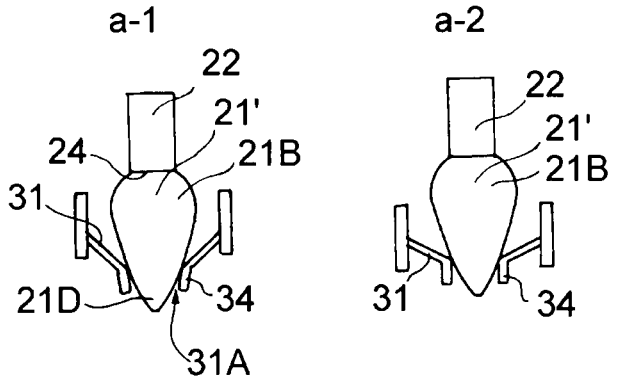
FIG. 20(*a*) and FIG. 20(*b*) present schematic front and side views, respectively, of another embodiment of the applying portion of the applicator being wiped by a flexible wiper.
Figure 20B:
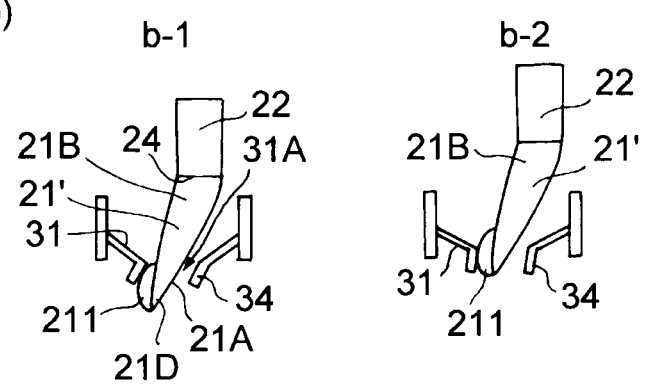
Figure 20C:
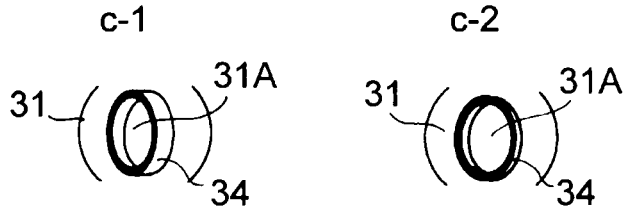

FIG. 20(*a*) illustrates front views of an applying portion 21' according to another embodiment being wiped by the flexible wiper 31. FIG. 20(*b*) illustrates side views of the applying portion 21' being wiped by the flexible wiper 31. FIG. 20(*c*) illustrates bottom views of the flexible wiper 31 wiping the applying portion 21' with the applying portion 21' omitted. The applying portion 21' of this embodiment has a thick protrusion 211 that protrudes from the side opposite to the applying side 21A in the tip portion of the applying portion 21.

In the FIGS. 20(*a*), 20(*b*), and 20(*c*), a-1, b-1, and c-1 show the state in which the applying portion 21' having been immersed in the cosmetic 4 (see FIG. 18) is pulled up until the protrusion 211 reaches the upper end of the flexible annular lip 34. In a-2, b-2, and c-2 is shown the state in which the applying portion 21' is further pulled up so that the protrusion 211 of the applying portion 21 passes through the wiper orifice 31A of the flexible wiper 31.

In that way, in the case of the applying portion 21' having the thick protrusion 211 in the tip portion thereof, too, the flexible annular lip 34 is deformed to reduce the resistance during the withdrawal thereby producing the same effects as described above. In addition thereto, the flexible annular lip 34 is further largely deformed on contact with the protrusion 211 provided in the tip portion of the applying portion 21' and thereby exhibits enhanced wiping effects to effectively avoid threading of the cosmetic 4.

Figure 21A:
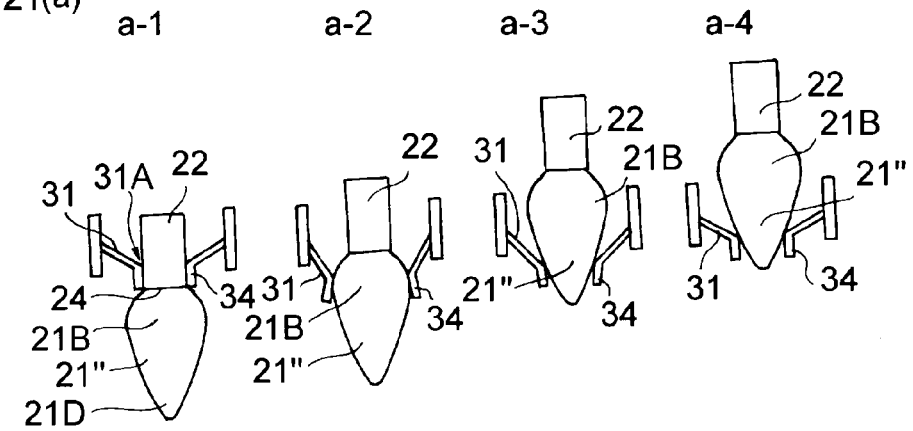
FIG. 21(*a*) and FIG. 21(*b*) present schematic front and side views, respectively, of still another embodiment of the applying portion of the applicator being wiped by a flexible wiper.
Figure 21B:
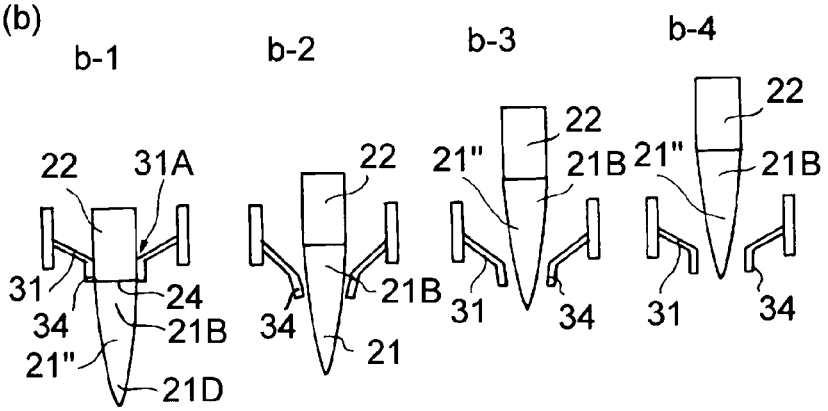
Figure 21C:
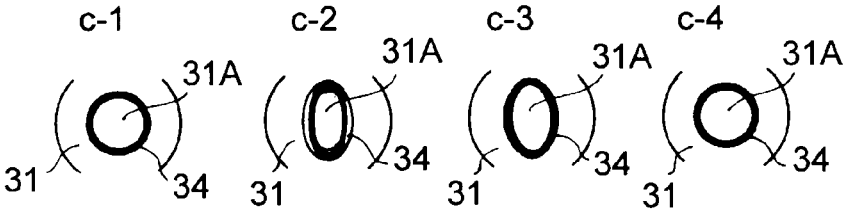

FIG. 21(*a*) illustrates front views of an applying portion 21" according to still another embodiment being wiped by the flexible wiper 31. FIG. 21(*b*) illustrates side views of the applying portion 21" being wiped by the flexible wiper 31. FIG. 21(*c*) illustrates bottom views of the flexible wiper 31 wiping the applying portion 21" with the applying portion 21" omitted. The applying portion 21" of this embodiment has the same structure as the applying portion 21, except that it is attached straight to the stem 22 with no inclination.

In the FIGS. 21(*a*), 21(*b*), and 21(*c*), a-1, b-1, and c-1 show the state in which the applying portion 21" having been immersed in the cosmetic 4 (see FIG. 18) is pulled up to reach the flexible wiper 31. In this state, the opening of the flexible annular lip 34 remains non-deformed (i.e., circular)

at both the upper end where the lip 34 connects to the flexible wiper 31 and the lower end, which is a free end.

In the FIGS. 21(*a*), 21(*b*), and 21(*c*), a-2, b-2, and c-2 show the state in which the applying portion 21" is further pulled up to have its widest part 21E located inside the flexible annular lip 34. In this state, since the width of the applicator 21" is larger than the diameter of the orifice 31A of the flexible wiper 31, the applying portion 21" widens the wiper orifice 31A in its width direction thereby to deform the shape of the wiper orifice 31A and the shape of the opening at the upper end of the flexible annular lip 34, which is continuous with the orifice 31A, into an elliptic shape. The lower end of the flexible annular lip 34, which is a free end and therefore is more flexibly deformable than the upper end, is deformed into a more flattened elliptic shape than the deformed shape of the opening defined by the upper end. As a result, the portion gradually decreasing in width of the applying portion 21 distal from the widest part 21E easily comes into contact with the flexible annular lip 34 having thus deformed to provide a flattened opening and is wiped effectively as shown in a-3, b-3, c-3 and a-4, b-4, and c-4.

Having the above described configuration, the applicator device 1 of the present embodiment can have the flexible annular lip 34 deformed to reduce the resistance when the applying portion 21" is withdrawn thereby to achieve effective wiping of the applying portion 21" with reduced damage to the wide and flattened applying portion 21" similarly to the above described case of the applying portion 21 or the applying portion 21'.

Figure 22A:
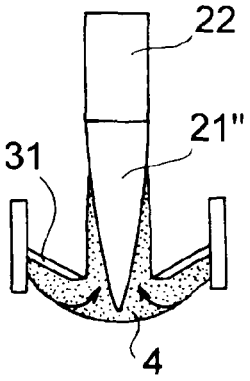
FIG. 22(*a*) illustrates a state in which a cosmetic deposited on the lower side of a flexible wiper is picked up by the applying portion in a conventional technique.
Figure 22B:
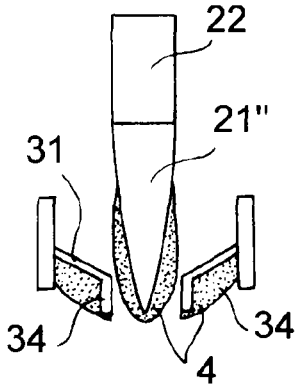

In the case where an applying portion 21" having no widest part as shown in FIG. 22(*a*) is combined with a wiper 31 having no flexible annular lip as shown in FIG. 22(*a*), if a cosmetic 4 having been wiped from the stem or the cosmetic 4 having been wiped off in the last use is deposited on the lower side of the flexible wiper 31 due to, for example, the high viscosity of the cosmetic, the applying portion 21" may pick up the deposited cosmetic 4 when pulled up while being wiped because of the absence of the flexible annular lip. This phenomenon can cause the applying portion 21" to pick up too much cosmetic 4 on its tip portion, which easily results in cosmetic threading.

According to the present embodiment, in contrast, since the flexible wiper 31 has the flexible annular lip 34 extending downward from the edge of the wiper orifice 31A, the cosmetic 4 deposited on the lower side of the flexible wiper 31 is hardly picked up. As a result, attachment of too much cosmetic 4 to the tip portion of the applying portion 21" is effectively avoided. Furthermore, the cosmetic 4 picked up by the applying portion 21" is easily separated from the cosmetic 4 deposited on the lower side of the flexible wiper 31 by the flexible annular lip 34, which is also effective in preventing the cosmetic 4 from threading.

While the cosmetic applicator device 1 according to the aforementioned embodiment has a funnel-shaped flexible wiper whose diameter decreases in the direction from the neck toward the bottom of the receptacle, the wiper may have other various shapes, such as a disk having a through-hole as a wiper orifice in the center thereof.

Figure 23A:
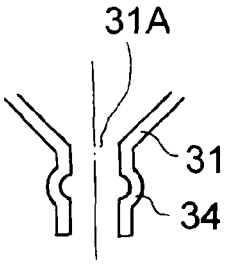
FIG. 23(*a*), FIG. 23(*b*), and FIG. 23(*c*) are schematic cross-sections of other configurations of a flexible annular wiper lip.
Figure 23B:
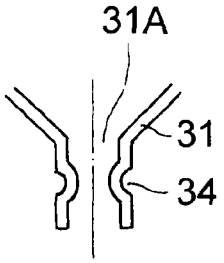
Figure 23C:
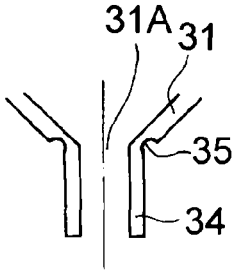

The flexible annular lip does not always have to be cylindrical and may have various alterations to have improved flexibility or deformability in a desired direction. For example, the flexible annular lip may have a bellows-like shape as shown in FIGS. 23(*a*) and 23(*b*) or may have a groove 35 around its base as shown in FIG. 23(*c*) so as to be more easily deformable. By making the flexible annular lip 34 bellows-like, the lower end of the lip 34 may move more largely, or the lip 34 may change in length during the passage of the applying portion.

Figures 24A, 24B, 24C, 24D, 24E:
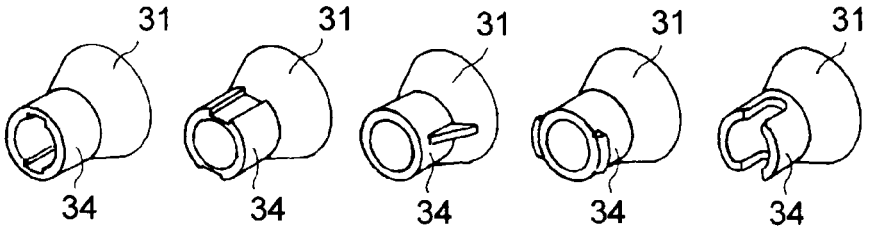
FIG. 24(*a*), FIG. 24(*b*), FIG. 24(*c*), FIG. 24(*d*), and FIG. 24(*e*) are perspective views of other configurations of a flexible annular wiper lip.
Figure 25A:
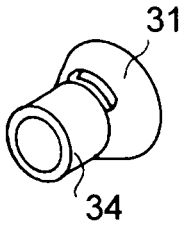
FIG. 25(*a*), FIG. 25(*b*), FIG. 25(*c*), and FIG. 25(*d*) are perspective views of other configurations of a flexible annular wiper lip and the flexible wiper.
Figure 25B:
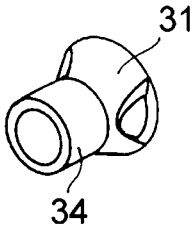
Figure 25C:
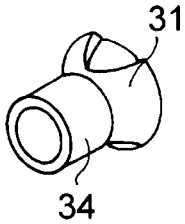
Figure 25D:
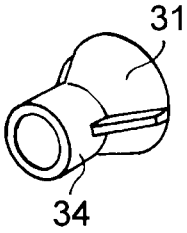

The flexible annular lip 34 may have its thickness varied in part by providing a thin-walled portion (as in FIGS. 24(*a*) and 24(*b*)) or a thick-walled portion (as in FIGS. 24(*c*) and 24(*d*)) or may have a cutout (as in FIG. 24(*e*)) so as to exhibit easier deformability in a prescribed direction. When a force is applied to the inner side of any of the flexible annular lips 34 shown in FIG. 24, the deformability of the annular lip differs depending on whether the force is imposed in the vertical direction or the horizontal direction in the perspective view. Therefore, it is possible to change the cosmetic pickup by the applying portion 21 depending on whether the applying portion 21 is withdrawn from the receptacle with its sides (the widest part 21E) facing in the vertical direction or the horizontal direction in FIG. 24. The cosmetic pickup by the applying portion 21 may also be changed by making the sides (the widest part 21E) of the applying portion 21 face in other than the vertical or horizontal direction, e.g., in a direction making an angle of 45 degrees with the vertical or horizontal direction. In using the flexible annular lip of these embodiments, it is preferred to put a mark indicating the direction of easy deformation on the applicator and the receptacle.

The flexible wiper 31 to which the flexible annular lip 34 connects may have its thickness varied in part by providing a thin-walled portion (as in FIGS. 25(*a*) and 25(*c*)) or a thick-walled portion (as in FIGS. 25(*b*) and 25(*d*)) to similarly cause the flexible annular lip 34 to have direction-dependent deformation.

While the members depicted in FIGS. 24 and 25 have two parts providing a varied thickness in plane symmetry, the number of the parts may be one or more than two. A thick-walled portion, a thin-walled portion, and a cutout may be provided in combination in the same flexible annular lip 34, the same flexible wiper 31, or both of them.

Figure 26:
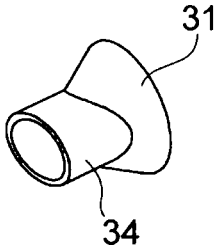
FIG. 26 is a perspective view of still another configuration of a flexible annular wiper lip.

Directionality of deformation of the flexible annular lip 34 may also be provided by making the wiper orifice and the cross-section of the flexible annular lip 34 elliptic as shown in FIG. 26. The peripheral edge of the wiper orifice 31A may be radially slitted.

While the invention has been described with reference to its preferred embodiments, it should be understood that the invention is not limited thereto. For example, the applying portion 21 of the applicator 2 of the embodiment shown in FIGS. 12 (*a*) and (*b*) may have a protrusion protruding on the first side (applying side) 21A instead of, or in addition to the protrusion 211 protruding on the side 21B opposite to the first side 21A. In this modification, the degree of protruding on the first side 21A and that on the second side 21B may be the same or different.

The invention claimed is:

1. A lip cosmetic applicator device comprising:

an applicator to apply a cosmetic to a lip; and a receptacle to contain the cosmetic, the applicator being able to be withdrawn from and insertable into the receptacle through a neck of the receptacle, wherein the applicator includes a stem and an applying portion connected to one end of the stem, the applying portion having a flattened shape and having an applying side to apply the cosmetic, when viewed from the front, the applying portion has a widest part and gradually decreases in width from the widest part to a tip portion of the applying portion, when viewed from the side, a thickness of a thickest part of the tip portion of the applying portion is thicker than a thickest part of the widest part of the applying portion, a direction of the thickness is transverse to a direction of the width, the applying portion is inclined with respect to a longitudinal axis of the stem such that the applying side of the applying portion is closer to the longitudinal axis of the stem than a non-applying side of the applying portion opposite the applying side, the thickness of the tip portion gradually increases from a free end thereof toward a proximal end of the applying portion until the thickest part of the tip portion is formed and then gradually decreases from the thickest part of the tip portion toward the proximal end, approaching the thickest part of the widest part, the thickness of the applying portion increases at all times from the widest part of the applying portion to the thickest part of the tip portion, and the applying portion is asymmetrical when viewed from the side.

2. The lip cosmetic applicator device according to claim 1, wherein the thickest part of the tip portion of the applying portion includes a protrusion on the non-applying side.

3. The lip cosmetic applicator device according to claim 1, wherein the tip portion is triangular with rounded corners in a transverse cross-section taken along the width direction of the applying portion.

4. The lip cosmetic applicator device according to claim 1, wherein the applying portion is inclined with respect to the longitudinal axis of the stem such that the applying side of the applying portion faces a bottom of the receptacle.

5. The lip cosmetic applicator device according to claim 1, wherein the receptacle comprises a flexible wiper at or near the neck of the receptacle and a flexible annular lip integral with the flexible wiper, the flexible wiper having a wiper orifice, and the flexible annular lip extending downward from an edge of the wiper orifice.

6. The lip cosmetic applicator device according to claim 5, wherein a value obtained by dividing the diameter of the wiper orifice by the outer diameter of the stem at a connecting position where the applying portion and the stem are connected to each other is 0.7 to 1.0, and a value obtained by dividing the length of the flexible annular lip by the length of the applying portion is 0.05 to 0.5.

7. The lip cosmetic applicator device according to claim 1, wherein the receptacle has a wiper at or near the neck of the receptacle, the wiper having in a substantially central portion of the wiper a wiper orifice through which the applying portion and the stem are passable, the widest part of the applying portion has a width larger than the largest width of the wiper orifice, and the applying portion is deformable with the applying side inward when it passes through the wiper orifice.

8. The lip cosmetic applicator device according to claim 1, wherein the receptacle has a wiper at or near the neck of the receptacle, the wiper having in a substantially central portion of the wiper a wiper orifice through which the applying portion and the stem are passable, the widest part of the applying portion has a width larger than a largest width of the wiper orifice, and the applying portion is deformable with the applying side inward when it passes through the wiper orifice, such that portions of the applying side deform towards other portions of the applying side when the applying portion passes through the wiper orifice.

9. The lip cosmetic applicator device according to claim 8, wherein the applying portion is inclined with respect to the longitudinal axis of the stem such that the applying side of the applying portion faces a bottom of the receptacle.

10. The lip cosmetic applicator device according to claim 8, wherein the wiper is a flexible wiper at or near the neck of the receptacle and a flexible annular lip integral with the flexible wiper, and the flexible annular lip extends downward from an edge of the wiper orifice.

11. The lip cosmetic applicator device according to claim 10, wherein a value obtained by dividing the diameter of the wiper orifice by the outer diameter of the stem at a connecting position where the applying portion and the stem are connected to each other is 0.7 to 1.0, and a value obtained by dividing the length of the flexible annular lip by the length of the applying portion is 0.05 to 0.5.

12. The lip cosmetic applicator device according to claim 8, wherein the applying portion has a thickness gradually increasing from the widest part of the applying portion to a connecting position where the applying portion and the stem connect to each other to have substantially the same thickness as the stem at the connecting position.

13. The lip cosmetic applicator device according to claim 8, wherein the widest part of the applying portion is located at a position away from a free end of the tip portion of the applying portion.

14. The lip cosmetic applicator device according to claim 8, wherein the applying portion has at least one straight or curved groove extending in its longitudinal direction on the non-applying side.

15. The lip cosmetic applicator device according to claim 7, wherein the non-applying side includes one or more grooves to induce deformation when the applying portion is deformed when it passes through the wiper orifice.

16. The lip cosmetic applicator device according to claim 15, wherein the non-applying side includes two grooves to induce deformation to a C-shape when the applying portion is deformed when it passes through the wiper orifice, the two grooves are laterally displaced from each other and extend in a longitudinal direction of the applying portion, and the deformation to the C-shape, when the applying portion is deformed when it passes through the wiper orifice, is to cause the applying side to maintain retention of the cosmetic when the cosmetic is removed from the receptacle.

17. The lip cosmetic applicator device according to claim 1, wherein the non-applying side has a concave surface.

18. The lip cosmetic applicator device according to claim 1, wherein the applying side is formed of a concave surface having a concavity in a center of the applying side.

19. The lip cosmetic applicator device according to claim 1, wherein the applying portion is inclined at a prescribed angle of 10° to 50° with respect to the longitudinal axis of the stem.

20. The lip cosmetic applicator device according to claim 18, wherein the applying side is formed of the concave surface such that the concave surface holds the cosmetic in the center of the applying side.

21. The lip cosmetic applicator device according to claim 18, wherein the concavity is formed by an outer outwardly rounded surface that gradually curves inwardly to form the concave surface and the concave surface is a continuous surface.

22. The lip cosmetic applicator device according to claim 1, wherein when viewed from the side, the thickness at the thickest part of the tip portion of the applying portion is less than a thickness of the stem at an interface of the applying portion and the stem at the one end of the stem.

23. The lip cosmetic applicator device according to claim 1, wherein the width of the applying portion increases at all times from a connection position of the applying portion to the stem to the widest part of the applying portion.

24. A lip cosmetic applicator to apply a cosmetic to a lip, the lip cosmetic applicator comprising:

a stem; and an applying portion that has a flattened shape and that is connected to an end of the stem, wherein the applying portion includes, in an axial direction extending from the stem, a connecting portion to connect the applying portion to the end of the stem, an applying side to apply the cosmetic, and a tip portion, the applying portion has a widest part proximate the connecting portion and gradually decreases in width from the widest part to the tip portion, in a side view, a thickness of a thickest part of the tip portion is thicker than a thickest part of the widest part of the applying portion, a direction of the thickness is transverse to a direction of the width, the applying portion is inclined with respect to a longitudinal axis of the stem such that the applying side of the applying portion is closer to the longitudinal axis of the stem than a non-applying side of the applying portion opposite the applying side, the thickness of the tip portion gradually increases from a free end thereof toward a proximal end of the applying portion until the thickest part of the tip portion is formed and then gradually decreases from the thickest part of the tip portion toward the proximal end, approaching the thickest part of the widest part, the thickness of the applying portion increases at all times from the widest part of the applying portion to the thickest part of the tip portion, and the applying portion is asymmetrical in the side view.

25. The lip cosmetic applicator according to claim 24, wherein the tip portion is triangular with rounded corners in a cross-section along the width direction of the applying portion.

26. The lip cosmetic applicator according to claim 24, wherein when viewed from the front, the applying portion has its width gradually increased from a free end of the tip portion to the widest part of the applying portion and gradually decreased from the widest part of the applying portion to the connecting position and the longitudinal axis of the stem.

27. The lip cosmetic applicator according to claim 24, wherein when viewed from the side, the thickness at the thickest part of the tip portion of the applying portion is less than a thickness of the stem at an interface of the applying portion and the stem at the end of the stem.

28. The lip cosmetic applicator according to claim 24, wherein the width of the applying portion increases at all times from a connection position of the applying portion to the stem to the widest part of the applying portion.

29. A lip cosmetic applicator device comprising:

an applicator to apply a cosmetic to a lip; and a receptacle to contain the cosmetic, the applicator being able to be withdrawn from and insertable into the receptacle through a neck of the receptacle, wherein the applicator includes a stem and an applying portion connected to one end of the stem, the applying portion having a flattened shape and having an applying side to apply the cosmetic, when viewed from the front, the applying portion has a widest part and gradually decreases in width from the widest part to a tip portion of the applying portion, when viewed from the side, a thickness of a thickest part of the tip portion of the applying portion is thicker than a thickest part of the widest part of the applying portion, a direction of the thickness is transverse to a direction of the width, the thickness of the tip portion gradually increases from a free end thereof toward a proximal end of the applying portion until the thickest part of the tip portion is formed and then gradually decreases from the thickest part of the tip portion toward the proximal end, approaching the thickest part of the widest part, the thickness of the applying portion increases at all times from the widest part of the applying portion to the thickest part of the tip portion, and the applying portion is asymmetrical when viewed from the side.

30. The lip cosmetic applicator device according to claim 29, wherein the tip portion is triangular with rounded corners in a cross-section along the width direction of the applying portion.

31. The lip cosmetic applicator device according to claim 29, wherein when viewed from the front, the applying portion has its width gradually increased from the free end of the tip portion to the widest part of the applying portion and gradually decreased from the widest part of the applying portion to a connecting position and an axis of the stem.

32. The lip cosmetic applicator device according to claim 29, wherein when view from the side, the thickness at the thickest part of the tip portion of the applying portion is less than a thickness of the stem at an interface of the applying portion and the stem at the one end of the stem.

33. The lip cosmetic applicator device according to claim 29, wherein the width of the applying portion increases at all times from a connection position of the applying portion to the stem to the widest part of the applying portion.

34. The lip cosmetic applicator device according to claim 29, wherein when viewed from the front, a distance from the widest part of the applying portion to the free end of the tip portion is greater than a distance from the widest part of the applying portion to a connecting position where the applying portion and the stem connect to each other.

* * * * *